US006435709B2

(12) United States Patent
Hirano et al.

(10) Patent No.: US 6,435,709 B2
(45) Date of Patent: Aug. 20, 2002

(54) BAND AND WRIST DEVICE

(75) Inventors: Tadao Hirano, Akiruno; Yuji Doi, Hachioji; Masaaki Hirai, Fussa; Hajime Iguchi, Fuchu, all of (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 09/789,204

(22) Filed: Feb. 20, 2001

Related U.S. Application Data

(62) Division of application No. 09/315,376, filed on Mar. 18, 1999, now Pat. No. 6,238,083.

(30) Foreign Application Priority Data

May 22, 1998 (JP) ..... 10-141740
Dec. 25, 1998 (JP) ..... 10-371445

(51) Int. Cl.[7] ..... A44C 5/00; G04B 37/00

(52) U.S. Cl. ..... 368/281; 368/282; 224/164; 224/173

(58) Field of Search ..... 368/88, 276, 281–282, 368/285; 224/164, 173; 24/265 WS

(56) References Cited

U.S. PATENT DOCUMENTS

| | | | | | |
|---|---|---|---|---|---|
| 2,319,269 | A | | 5/1943 | Schwalberg | |
| 2,619,270 | A | | 11/1952 | Foster | |
| 3,019,503 | A | * | 2/1962 | Placco et al. | |
| 3,165,884 | A | * | 1/1965 | Gwinner et al. | 368/282 |
| 3,889,323 | A | | 6/1975 | Reith | |
| 4,023,347 | A | * | 5/1977 | Haber | 368/285 |
| 4,266,326 | A | | 5/1981 | Hong | |
| 4,742,502 | A | * | 5/1988 | Tomoda | 368/282 |
| 5,206,841 | A | * | 4/1993 | Boucheron | 368/276 |
| 6,168,055 | B1 | * | 1/2001 | Grados | 224/152 |

* cited by examiner

*Primary Examiner*—Vit Miska
(74) *Attorney, Agent, or Firm*—Frishauf, Holtz, Goodman & Chick, P.C.

(57) ABSTRACT

A wrist device is provided which includes a case body and bands attached to the case body. The wrist device also includes covering portions which cover a portion of the case body.

4 Claims, 17 Drawing Sheets

BAND AND WRIST DEVICE

This is a division of application Ser. No. 09/315,376 filed May 18, 1999, now U.S. Pat. No. 6,238,083.

BACKGROUND OF THE INVENTION

1. Field of the Invention

The present invention relates to a band which is useful for applications such as a watch, a compass, a water depth gauge, or the like and to a wrist device for being worn on the wrist, having a band for a watch, a compass, a water depth gauge, or the like.

2. Description of Related Art

In recent years, as a watch band, a band which is made of composite materials, of which members are made of various materials are combined has been known. For example, a band in which soft synthetic resin and a fiber which is nylon or the like are combined, a band in which soft synthetic resin and metal are combined, or the like have been known.

In a case of combination of soft synthetic resin and metal, a metal insert molding that a metal member is set in a mold, thereafter resin is filled to form a band is generally applied.

A watch band of which a metal member is made of metal is secured to a band body made of soft synthetic resin by a double-coated tape or the like has also been known.

Recently, a watch band of which members are made of soft synthetic resin having different colors are combined has been known. For example, the band having a structure that a decorative piece is forced in a hole portion which is formed in a band body from an under surface or that a band body is inserted into a loop-like decorative member, thereafter a claw disposed on a projecting portion of the loop-like decorative member is inserted in a groove formed in the band body has been known.

Conventionally, there is no wrist device for being worn on the wrist which has a band for a watch, a compass, a water depth gauge, or the like and a design which is improved in terms of the unity of the case body (hereinafter referred to as a "case complete") and the band by covering a portion of the case complete with the band or a decorative member attached to the band.

In a case that the watch band molded by the metal insert molding, because a member made of metal is set in the mold to fix and mold to form the band, there is a problem that when a metal of which surface is treated, for example, an alumite or the like is used, the surface treated layer cracks, or the like.

In a case that the watch band of which the metal member is secured to the band body made of soft synthetic resin by the double-coated tape or the like, there are problems that urethane which is mainly applied as the soft synthetic resin is difficult to secure, further, when the watch band is twisted, the metal member easily falls off.

In a case that the watch band of which members are made of soft synthetic resin having different colors are combined, there are problems that a space is occurred between the hole portion of the band body and the decorative piece, the decorative piece falls off, further, the claw comes out from the groove, so that the decorative member, especially, the projecting portion thereof turnovers from the band body, or the like. Accordingly, it is not attractive and it is difficult to obtain the unity of the watch band.

SUMMARY OF THE INVENTION

An object of the present invention is to provide a band in which a decorative member made of metal or soft synthetic resin is combined to a band body made of soft synthetic resin, wherein the decorative member is certainly attached to the band body, with relatively plain structure. For example, when the decorative member is made of metal, it is held in a state of being certainly attached, and when the decorative member is made of soft synthetic resin, it is obtained that the unity of the band like a coinjection molding without a space and turnover, so that the band is attractive.

Another object of the present invention is to provide a wrist device having a design which is improved the unity of a case complete and a band by covering a portion of the case complete by the band or a decorative member attached to the band, so that it is attractive.

BRIEF DESCRIPTION OF THE DRAWINGS

FIGS. 23A to 23E show a band body to be attached to the case complete: wherein FIG. 23A is a plan view thereof: FIG. 23B is a plan view in a rear side thereof: FIG. 23C is a view taken in the direction of an arrow c of FIG. 23A: FIG. 23D is an enlarged cross-sectional view taken along the line D—D of FIG. 23A: and FIG. 23E is a partially enlarged view of FIG. 23A;

FIGS. 24A to 24F show a decorative member: wherein FIG. 24A is a plan view thereof: FIG. 24B is a cross-sectional view taken along the line G—G of FIG. 24A: FIG. 24C is a perspective view taken from oblique underside of FIG. 24A: FIG. 24D is a partial plan view in a rear side of FIG. 24A: FIG. 24E is a view taken in the direction of an arrow H of FIG. 24B: and FIG. 24F is a view taken in the direction of an arrow I of FIG. 24B;

FIGS. 25A to 25D show another band body to be attached to the case complete: wherein FIG. 25A is a plan view thereof: FIG. 25B is a plan view in a rear side thereof: FIG. 25C is an enlarged view taken in the direction of an arrow E of FIG. 25A: and FIG. 25D is an enlarged cross-sectional view taken along the line F—F of FIG. 25A.

PREFERRED EMBODIMENT OF THE INVENTION

The band according to each embodiment of the present invention will be explained with reference to FIGS. 1 to 26 as follows.

First Embodiment

Figure 1:
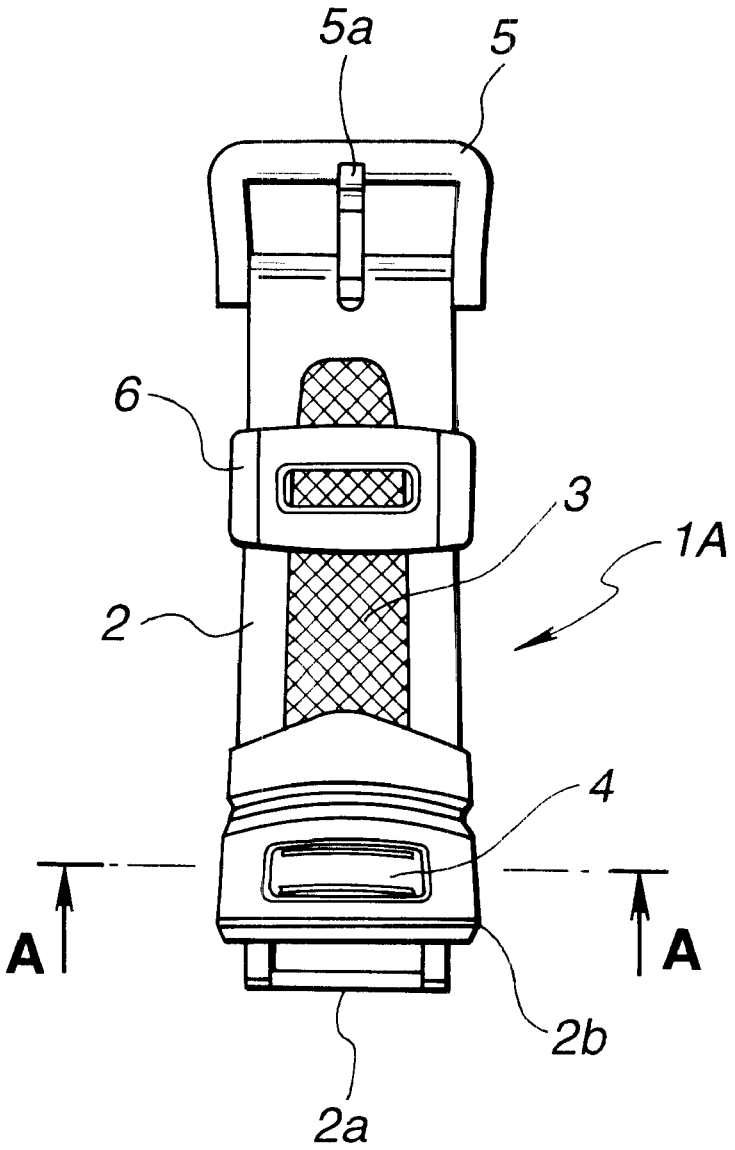
FIG. 1 is a plan view showing one half body of a watch band according to an example of the invention.
Figure 2:
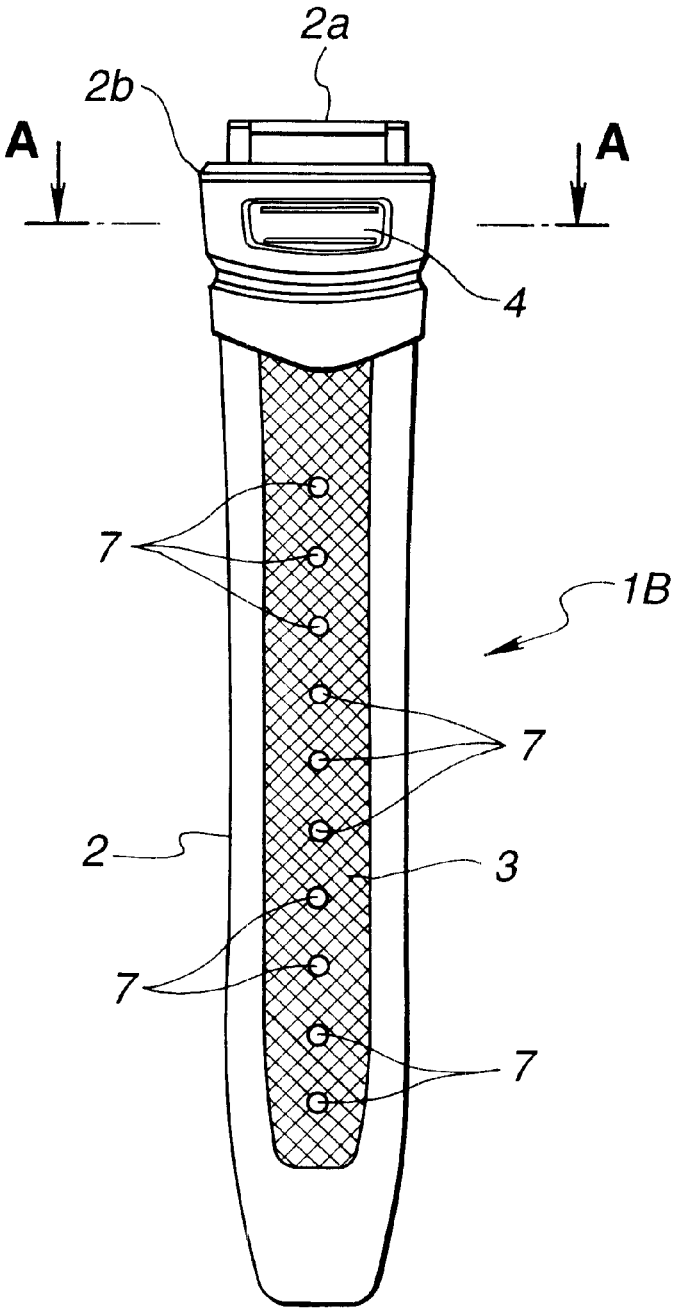
FIG. 2 is a plan view showing the other half body to be combined with the one half body of FIG. 1.

FIG. 1 is a plan view showing one half body of a watch band according to an example of the invention, and FIG. 2 is a plan view showing the other half body to be combined with the one half body.

One half body 1A of a watch band, as shown in FIG. 1, comprises a band body 2 which is made of soft synthetic resin and made as a body with surrounding a fiber 3 made of nylon or the like. The band body 2 comprises a wide attaching portion 2*b* which is provided with an attaching boss 2*a* for attaching the band body 2 to a case complete which is not shown. A plate-like decorative member 4 which is made of metal is attached to a surface of the wide attaching portion 2*b*.

A holder 5 having a tongue 5*a* is attached to an end portion of the band body 2, which is an opposite side of the attaching portion 2*b*. The band body 2 is provided with a loop 6 in an intermediate portion thereof.

The other half body 1B of a watch band, as shown in FIG. 2, is used by being combined with the half body 1A shown in FIG. 1. The other half body 1B also comprises a band body 2 which is made of soft synthetic resin and made as a body with surrounding a fiber 3. The band body 2 comprises the wide attaching portion 2*b* which is provided with the attaching boss 2*a*. The plate-like decorative member 4 which is made of metal is attached to the surface of the wide attaching portion 2*b*.

A large number of holding holes 7 are formed through the fiber 3 which is surrounded by the band body 2.

The way of attaching the plate-like decorative member 4 which is made of metal to the band body 2 will explained as follows.

Figure 3:
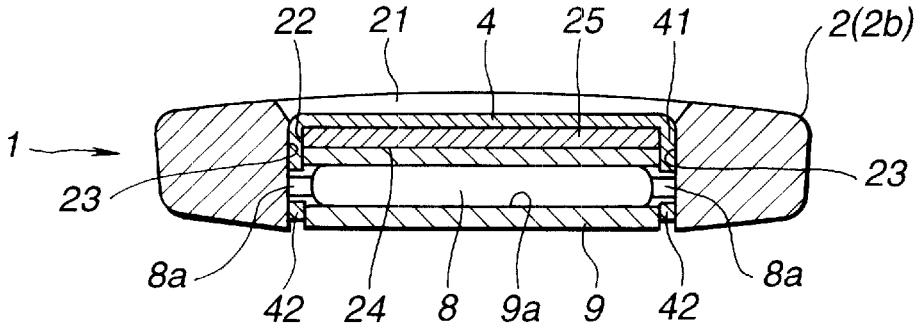
FIG. 3 is an enlarged cross-sectional view showing a watch band according to the first embodiment of the invention, taken along the line A—A of FIGS. 1 and 2.
Figure 4:
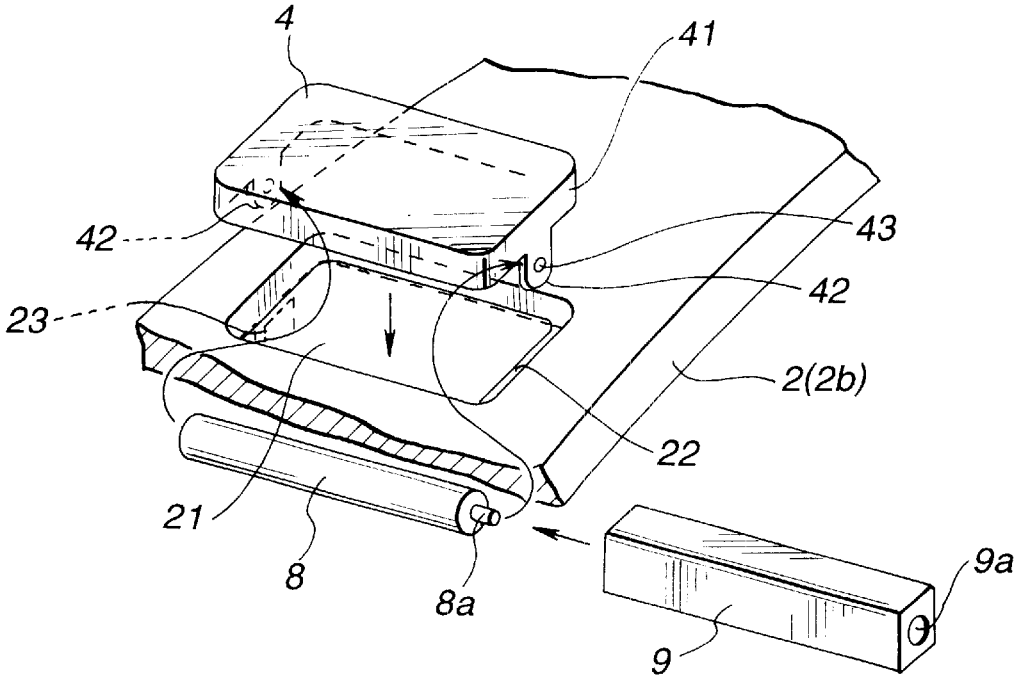
FIG. 4 is an exploded perspective view showing members of the watch band shown in FIG. 3.
Figure 5:
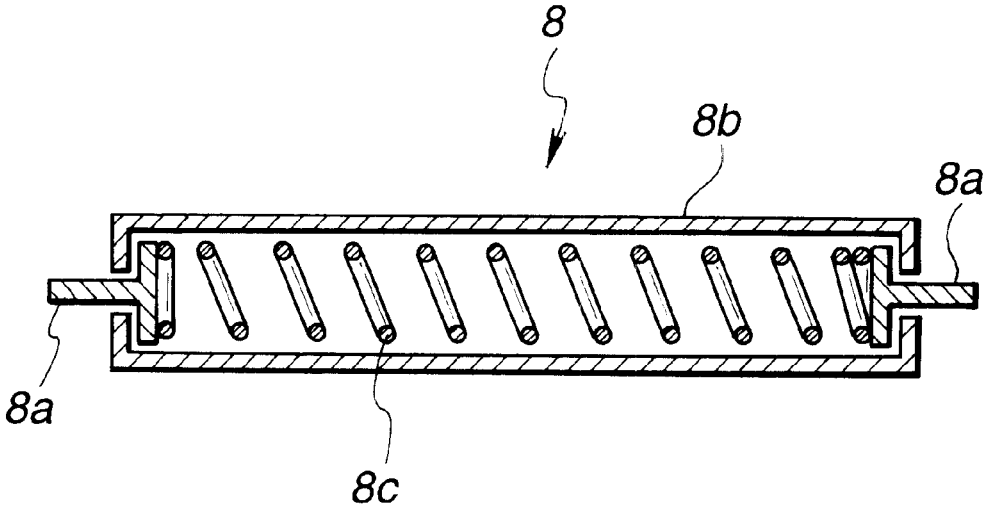
FIG. 5 is a central cross-sectional view showing an inner structure of a bar-like member (spring bar)

A watch band 1 comprises the above-described one half body 1A and the other half body 1B. FIG. 3 is an enlarged cross-sectional view showing the watch band according to the first embodiment of the invention, taken along the line A—A of FIGS. 1 and 2, and FIG. 4 is an exploded perspective view showing members thereof. FIG. 5 is a central cross-sectional view showing an inner structure of a bar-like member, for example, a spring bar.

In FIGS. 3 to 5, reference numeral 1 denotes a watch band, reference numeral 2 denotes a band body which is made of soft synthetic resin, reference numeral 2*b* denotes an attaching portion to a side of a case complete, reference numeral 4 denotes a plate-like decorative member which is made of metal, similarly as above-described, reference numeral 21 denotes a front side recess portion in a front surface side of the band, reference numeral 22 denotes peripheral insertion grooves, reference numeral 23 denotes a pair of insertion holes, reference numeral 24 denotes a rear side recess portion in a rear side surface of the band, reference numeral 25 denotes a bulkhead portion, reference numeral 41 denotes peripheral portions, reference numeral 42 denotes a pair of inserting tub-like portions, reference numeral 43 denotes a small hole, reference numeral 8 denotes a bar-like member, reference numeral 8*a* denotes a projecting portion, reference numeral 8*b* denotes a cylindrical portion, reference numeral 8*c* denotes a compression coil spring, reference numeral 9 denotes a covering member, and reference numeral 9*a* denotes a penetrating portion.

In the first embodiment, in the vicinity of the attaching portion 2*b* of the band body 2 which is made of soft synthetic resin, as shown in Figures, the front side recess portion 21 which has approximately oblong rectangle shape is formed, the peripheral insertion grooves 22 in peripheries of the front side recess portion 21 are formed, the pair of insertion holes 23 as insertion portions which are penetrating through the band body 2 in a front and rear direction of the band body 2 and apart from each other in a width direction of the band body 2 in the peripheral insertion grooves 22 are formed, and the rear side recess portion 24 which is transversely oblong is formed. The band body 2 comprises a bulkhead portion 25 between the front side recess portion 21 and the rear side recess portion 24.

A shape of the plate-like decorative member 4 which is made of metal has an approximately oblong rectangle shape to fit the front side recess portion 21 of the band body 2. The plate-like decorative member 4 comprises the peripheral portions 41 bent downwardly all around the plate-like decorative member 4 and the pair of inserting tab-like portions 42 and 42 which downwardly project from both the right and the left, of the peripheral portions 41. In the inserting tab-like portions 42, the small hole 43 is formed, respectively.

The projecting portions 8*a* and 8*a* are attached to both end portions of the cylindrical portion 8*b*. The compression coil spring 8*c* is incorporated in the cylindrical portion 8*b* to always energise the projecting portions 8*a* and 8*a* in a projection direction. Then, the bar-like member 8 having the spring bar is prepared. The prismatic covering member 9 in which the penetrating portion 9*a* for inserting the bar-like member 8 therethrough is formed is also prepared.

The projecting portions 8*a* and 8*a* of the bar-like member 8 having the spring bar are for inserting to the both small holes 43 and 43 of the pair of inserting tab-like portions 42 and 42 of the decorative member 4.

The covering member 9 is made of hard synthetic resin and prismatic to fit the rear side recess portion 24 which is transversely oblong, of the band body 2.

As shown in FIG. 4 with arrows, the peripheral portions 41 of the decorative member 4 are inserted to the peripheral insertion grooves 22 of the band body 2 from the front surface side and the inserting tab-like portions 42 and 42 are inserted to the insertion holes 23 and 23, respectively, so that a plate-like face portion of the decorative member 4 is overlapped on the front side recess portion 21.

Then, as also shown in FIG. 4 with arrows, the projecting portions 8*a* and 8*a* in the both end portions of the bar-like member 8 which is inserted through the penetrating portion 9*a* of the prismatic covering member 9 are inserted, respectively, to the small holes 43 and 43 of the inserting tab-like portions 42 and 42 of the decorative member 4 in the rear side recess portion 24. The prismatic covering member 9 fits in the rear side recess portion 24 of the band body 2, which is transversely oblong.

As above-described, the decorative member 4 made of metal is incorporated to the band body 2 made of soft synthetic resin by the bar-like member 8 having the spring bar without applying the metal insert molding. Accordingly, it is possible to securely incorporate the decorative member 4 made of metal to the band body 2 without influencing a surface treatment of the decorative member 4.

Therefore, it is possible to improve degrees of freedom of designs of the decorative member 4 made of metal.

Further, because the bar-like member 8 having the spring bar is covered by the prismatic covering member 9, thereafter the prismatic covering member 9 is contained in the rear side recess portion 24 of the band body 2, it is difficult to see the bar-like member 8 from the rear surface side of the band. Accordingly, for example, if the bar-like member 8 having the spring bar corrodes, it is not noticeable in appearance.

Modified Embodiment

Figure 6:
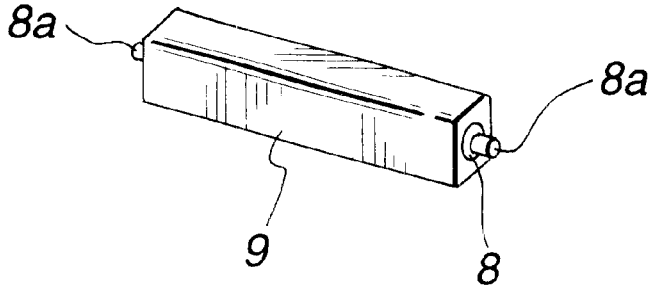
FIG. 6 is a perspective view showing a bar-like member and a covering member according to a modified embodiment.

FIG. 6 is a perspective view showing a bar-like member 8 and a covering member 9 according to a modified embodiment. In the modified embodiment, as shown, the covering member 9 made of hard synthetic resin is formed as a body into a prismatic shape, that is, the metal insert molding, with the metal bar-like member 8 having the spring bar, which is embedded in the center of the covering member 9.

As above-described, the covering member 9 made of hard synthetic resin, in which the metal bar-like member 8 having the spring bar is embedded, and which is formed by the insert molding can be applied.

In the above-described first embodiment and modified embodiments, the pair of insertion holes 23 and 23 which penetrate through the band in the front and the rear directions are shown as examples of a pair of insertion portions. However, the pair of insertion portions can be a pair of recess portions which is formed in the band. The pair of insertion portions, that is, the insertion holes 23 and 23 are formed apart from each other in the width direction of the band. However, a positional relationship between the pair of insertion portions can be varied, for example, the pair of insertion portions can be formed apart form each other in a longitudinal direction of the band.

Second Embodiment

Figure 7:
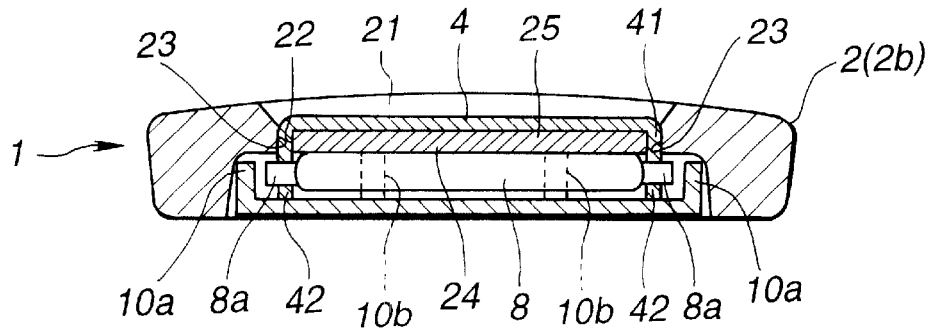
FIG. 7 is an enlarged cross-sectional view showing a watch band according to the second embodiment of the invention, taken along the line A—A of FIGS. 1 and 2.
Figure 8:
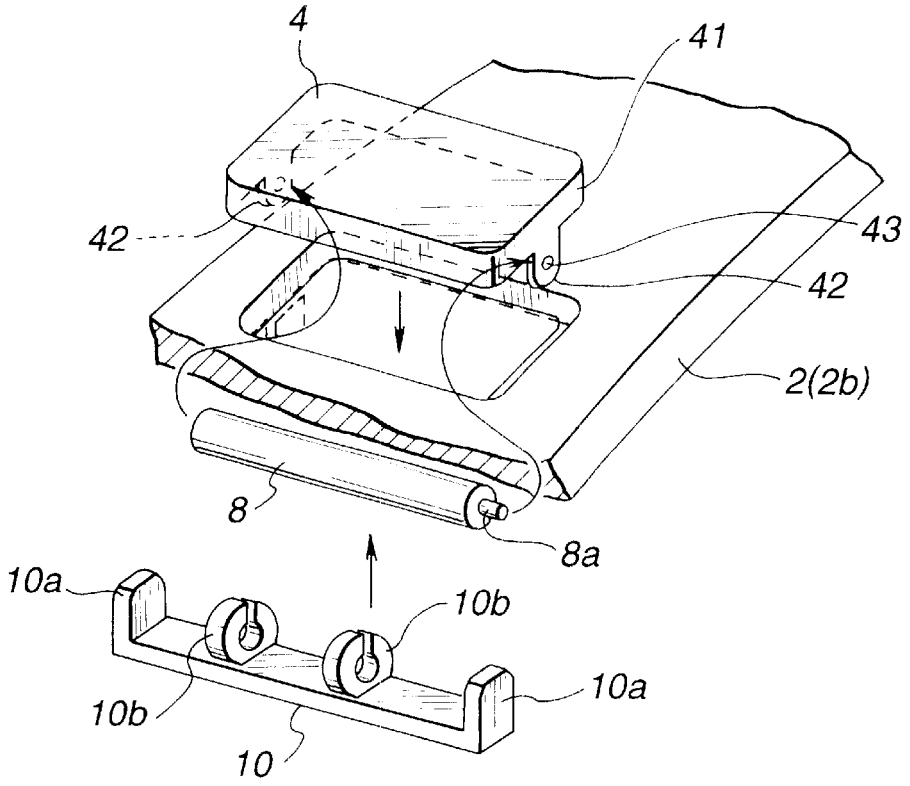
FIG. 8 is an exploded perspective view showing members of the watch band shown in FIG. 7.

FIG. 7 is an enlarged cross-sectional view showing a watch band according to the second embodiment of the invention, taken along the line A—A of FIGS. 1 and 2, and FIG. 8 is an exploded perspective view showing members thereof.

In FIGS. 7 and 8, as the above-described first embodiment, reference numeral 1 denotes the watch band, reference numeral 2 denotes the band body which is made of soft synthetic resin, reference numeral 2*b* denotes the attaching portion to the side of the case complete, reference numeral 4 denotes the plate-like decorative member which is made of metal, reference numeral 21 denotes the front side recess portion, reference numeral 22 denotes the peripheral insertion grooves, reference numeral 23 denotes the pair of insertion holes, reference numeral 24 denotes a rear side recess portion, reference numeral 25 denotes a bulkhead portion, reference numeral 41 denotes the peripheral portions, reference numeral 42 denotes the pair of inserting tub-like portions, reference numeral 43 denotes the small hole, reference numeral 8 denotes the bar-like member, reference numeral 8*a* denotes the projecting portion, reference numeral 10 denotes a covering member, reference numeral 10*a* denotes an end bent tab, and reference numeral 10*b* denotes an engaging portion which is a cut out ring-like portion.

The second embodiment is mainly different from the first embodiment in the structure of the covering member 10, so that only the difference will be explained as follows.

The covering member 10 has, as shown, a transversely oblong plate-like shape. The covering member 10 is made of soft synthetic resin in which the end bent tabs 10*a* and 10*a* in both end portions of the covering member and the pair of cut out ring-like portions 10*b* and 10*b* which are C-shaped in side view and engaging portions in intermediate portion are made as a body.

A length between the end bent tabs 10*a* and 10*a* in both end portions of the covering member 10 having the transversely oblong plate-like shape is made longer than a length of the bar-like member 8 having the spring bar, which contains the projecting portions 8*a* and 8*a* in the both end portions.

The rear side recess portion 24 of the band body 2 has, as shown, a length which is transversely longer than that of the first embodiment, as shown in FIG. 3.

In a case that the covering member 10 above-described is applied, at first, the projecting portions 8*a* and 8*a* in the both end portions of the bar-like member 8 having the spring bar are inserted into the small holes 43 and 43 of the inserting tab-like portions 42 and 42 of the decorative member 4 in the rear side recess portion 24 of the band body 2, respectively.

Thereafter, in the rear side recess portion 24 of the band body 2, as shown in FIG. 8 with arrows, the pair of cut out ring-like portions 10*b* and 10*b* of the oblong plate-like covering member 10 are fitted around the bar-like member 8 having spring bar, respectively.

Accordingly, the oblong plate-like covering member 10 including the end bent tabs 10*a* and 10*a* in both end portions is just fitted in the rear side recess portion 24.

Third Embodiment

Figure 9:
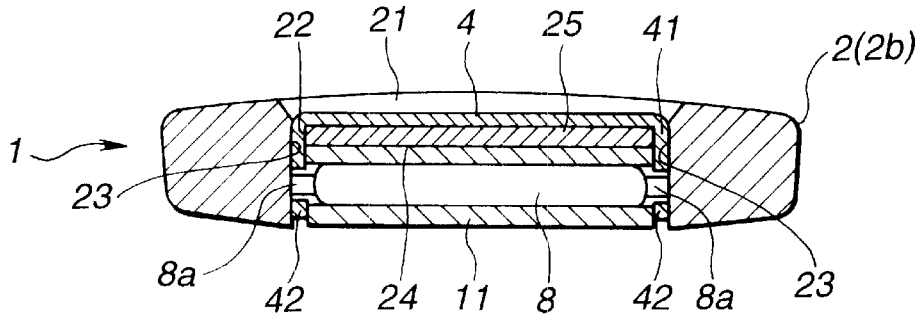
FIG. 9 is an enlarged cross-sectional view showing a watch band according to the third embodiment of the invention, taken along the line A—A of FIGS. 1 and 2.
Figure 10:
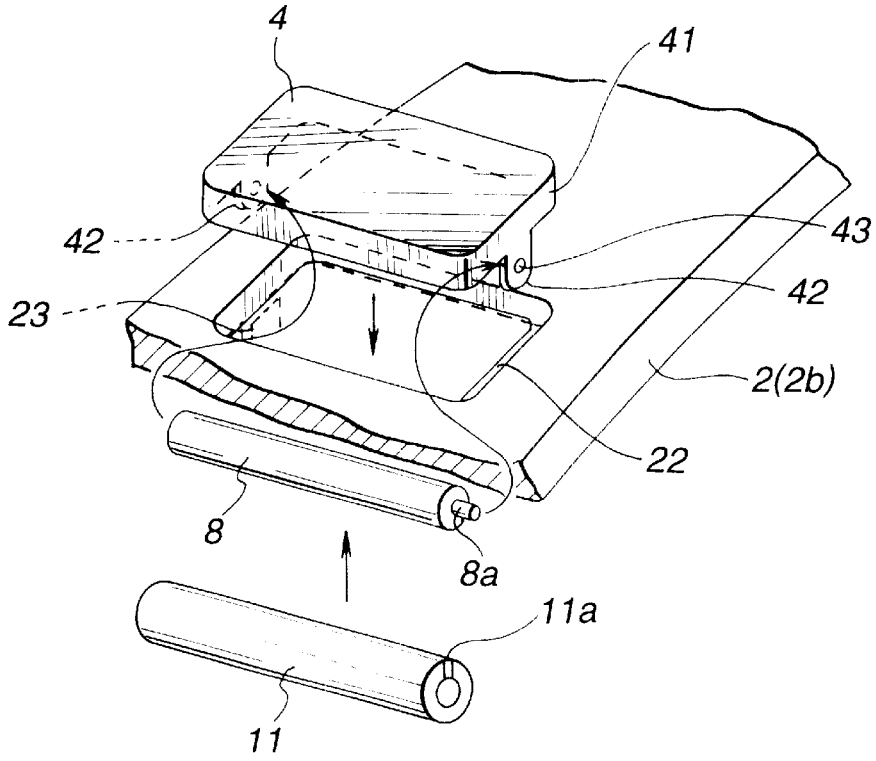
FIG. 10 is an exploded perspective view showing members of the watch band shown in FIG. 9.

FIG. 9 is an enlarged cross-sectional view showing a watch band according to the third embodiment of the invention, taken along the line A—A of FIGS. 1 and 2, and FIG. 10 is an exploded perspective view showing members thereof.

In FIGS. 9 and 10, as the above-described first embodiment, reference numeral 1 denotes the watch band, reference numeral 2 denotes the band body which is made of soft synthetic resin, reference numeral 2*b* denotes the attaching portion to the side of the case complete, reference numeral 21 denotes the front side recess portion, reference numeral 22 denotes the peripheral insertion grooves, reference numeral 23 denotes the pair of insertion holes, reference numeral 24 denotes the rear side recess portion, reference numeral 25 denotes a bulkhead portion, reference numeral 4 denotes the plate-like decorative member which is made of metal, reference numeral 41 denotes the peripheral portions, reference numeral 42 denotes the pair of inserting tub-like portions, reference numeral 43 denotes the small hole, reference numeral 8 denotes the bar-like member, reference numeral 8*a* denotes the projecting portion, reference numeral 11 denotes a covering member, and reference numeral 11*a* denotes a slit.

The third embodiment is mainly different from the first embodiment in the structure of the covering member 11, so that only the difference will be explained as follows.

The covering member 11 has, as shown, a transversely oblong cylindrical shape and is made of soft synthetic resin, in which the slit 11*a* is formed in a longitudinal direction thereof.

In a case that the covering member 11 is applied, as the second embodiment above-described, at first, the projecting portions 8*a* and 8*a* in the both end portions of the bar-like member 8 having the spring bar are inserted respectively into the small holes 43 and 43 of the inserting tab-like portions 42 and 42 of the decorative member 4 in the rear side recess portion 24 of the band body 2.

Thereafter, in the rear side recess portion 24 of the band body 2, as shown in FIG. 10 with arrows, the oblong cylindrical covering member 11 is pushed against the bar-like member 8 to open in the slit 11*a* and fitted around the bar-like member 8 having spring bar.

Accordingly, the oblong cylindrical covering member 11 is just fitted in the rear side recess portion 24.

Fourth Embodiment

Figure 11:
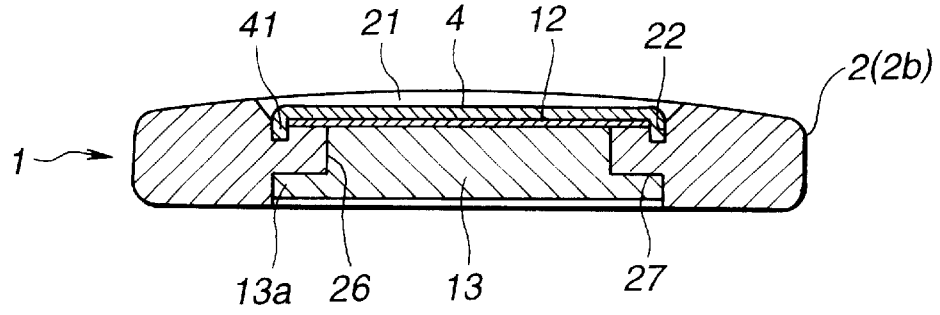
FIG. 11 is an enlarged cross-sectional view showing a watch band according to the fourth embodiment of the invention, taken along the line A—A of FIGS. 1 and 2.
Figure 12:
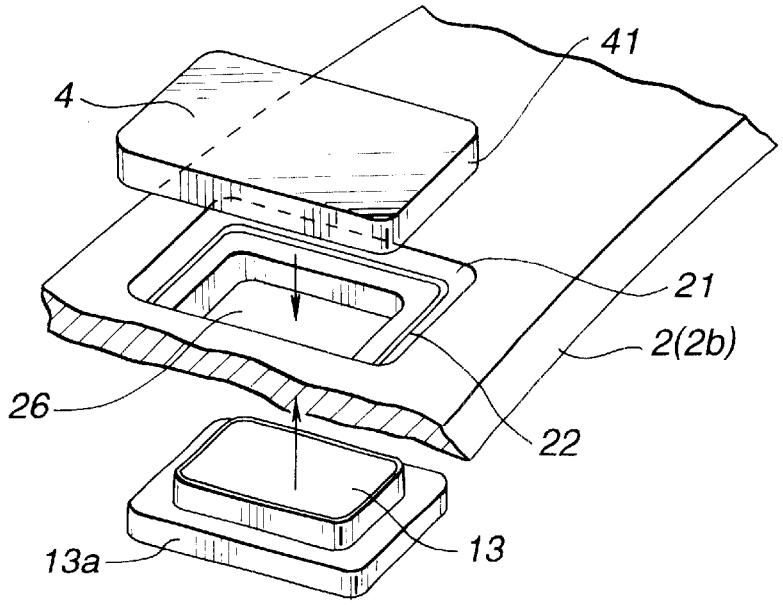
FIG. 12 is an exploded perspective view showing members of the watch band shown in FIG. 11.

FIG. 11 is an enlarged cross-sectional view showing a watch band according to the fourth embodiment of the invention, taken along the line A—A of FIGS. 1 and 2, and FIG. 12 is an exploded perspective view showing members thereof.

In FIGS. 11 and 12, as the above-described first embodiment, reference numeral 1 denotes the watch band, reference numeral 2 denotes the band body which is made of soft synthetic resin, reference numeral 2*b* denotes the attaching portion to the side of the case complete, reference numeral 21 denotes a front side recess portion, reference numeral 22 denotes peripheral insertion grooves, reference numeral 4 denotes a plate-like decorative member which is made of metal, reference numeral 41 denotes peripheral portions, reference numeral 12 denotes a double-coated tape, reference numeral 13 denotes a holding member, reference numeral 13*a* denotes a flange portion, reference numeral 26 denotes a penetrating portion, and reference numeral 27 denotes a rear side recess portion.

In the fourth embodiment, as shown, the penetrating portion 26 of which periphery has a rectangle shape, which penetrates in the front and the rear directions of the band in the front side recess portion 21 is formed in the band body 2, that is, in the attaching portion 2*b* in addition to the front side recess portion 21 and the peripheral insertion grooves 22. The rear side recess portion 27 having a rectangle shape, which surrounds the penetrating portion 26 in the rear surface side is also formed in the band body 2.

The pair of insertion holes 23, the rear side recess portion 24 which is transversely oblong and the bulkhead portion 25, as in the first to the third embodiments are not formed in the band body 2. The bar-like member 8 and the covering members 9, 10, and 11 are not applied, either.

The decorative member 4 does not comprise the insertion tab-like portions 42 in the peripheral portions 41.

Then, the double-coated tape 12 having a size corresponding to a bottom surface of the front side recess portion 21 of the band body 2 and the block-like holding member 13 having a size corresponding to the penetrating portion 26 of the band body 2 are prepared.

The holding member 13 is made of hard synthetic resin and comprises the flange portions 13*a* in lower peripheral portions of the block-like portion which is corresponds to the penetrating portion 26. The flange portions 13*a* have a shape corresponding to the rear side recess portion 27 which is rectangular.

The double-coated tape 12 is adhered to a lower surface of the plate-like face portion of the decorative member 4. Thereafter, as shown in FIG. 12 with arrows, the peripheral portions 41 of the decorative member 4 are inserted to the peripheral insertion grooves 22 of the band body 2 from the front surface side and the plate-like face portion is overlapped on the front side recess portion 21. In the time, peripheral portions of the double-coated tape 12 are adhered to the bottom surface of the front side recess portion 21 in the periphery of the penetrating portion 26.

As shown in FIG. 12 with arrows, the block-like portion of the block-like holding member 13 is fitted in the penetrating portion 26 from the rear surface side of the band body 2 and simultaneously the flange portion 13*a* is fitted in the rear side recess portion 27. Then, an upper surface of the block-like portion of the holding member 13 is adhered to the double-coated tape 12.

As described above, the decorative member 4 which is made of metal is attached to the band body 2 which is made of soft synthetic resin by being adhered to the holding member 13 which is made of hard synthetic resin through the double-coated tape 12, it is possible to obtain a stable adhesion strength between the decorative member 4 and the holding member 13.

Because both of the decorative member 4 and the holding member 13, which are adhered to each other are rigid bodies which are made of metal and hard synthetic resin, respectively, it is advantageous that deformation thereof against a bending force, a twisting force or the like, of the band body 2 is small.

Modified Embodiment

Figure 13:
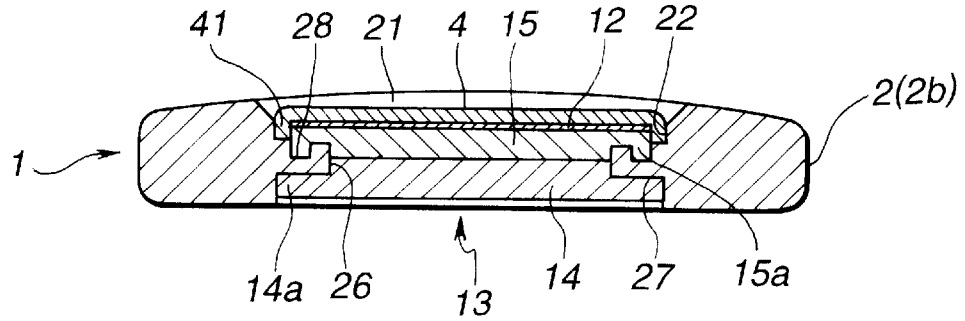
FIG. 13 is a cross-sectional view showing a watch band according to a modified embodiment (1) of the watch band shown in FIG. 11.

FIG. 13 is a cross-sectional view showing a watch band according to a modified embodiment (1) of the members of the watch band shown in FIG. 11. In this modified embodiment, as shown in the Figure, the holding member 13 which is made of hard synthetic resin is comprises a rear side member 14 and a front side member 15, which are two segments in lower and upper parts.

That is, the rear side member 14 comprises a flange portions 14*a* in lower peripheral portions thereof corresponding to an approximately lower half of the penetrating portion 26. The flange portions 14*a* have a shape corresponding to the rear side recess portion 27 which is rectangular.

The front side member 15 comprises peripheral portions 15*a* in peripheral portions thereof corresponding to an approximately upper half of the penetrating portion 26. The peripheral portions 15*a* have a shape which projects downwardly and corresponds to inner insertion grooves 28 which is formed between the peripheral insertion grooves 22 and the penetrating portion 26 in the front side recess portion 21.

The front side member 15 of the holding member 13 is, at first, adhered to the lower surface of the plate-like face portion of the decorative member 4 through the double-coated tape 12.

The decorative member 4 with the front side member 15 in the lower portion thereof is inserted to the band body 2 from the front surface side, so that the front side member 15is fitted to the penetrating portion 26, simultaneously, the peripheral portions 15*a* are fitted to inner insertion grooves 28, and the peripheral portions 41 of the decorative member 4 are fitted to the peripheral insertion grooves 22 which is outer of the inner insertion grooves 28.

The rear side member 14 of the holding member 13 is fitted to the penetrating portion 26 from the rear surface side of the band body 2, simultaneously, the flange portions 14*a* are fitted to the rear side recess portion 27.

Thereafter, contacted surfaces between the rear side member 14 and the front side member 15, which constitute the holding member 13 are joined to fix by ultrasonic welding.

Accordingly, it is possible to sandwich the band body 2 around the penetrating portion 26, between the rear side member 14 and the front side member 15, which are segments and constituting the holding member 13 which is made of hard synthetic resin. Therefore, because it is difficult to transmit a bending force, a twisting force or the like, of the band body 2 to the decorative member 4 which is made of metal, it is possible to obtain a more stable fixing force for decorative member 4.

Figure 14:
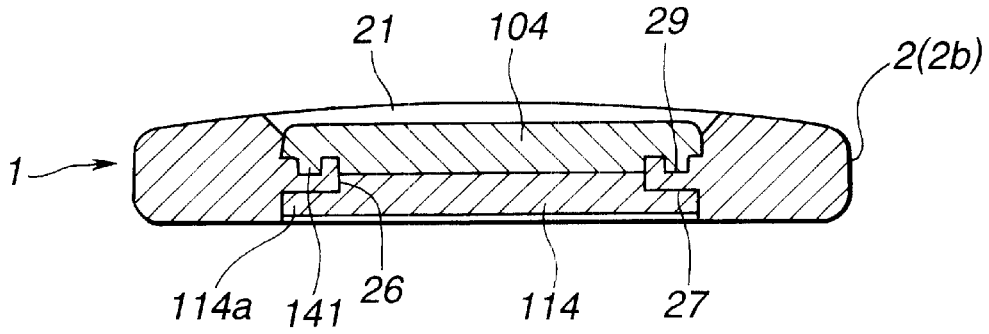
FIG. 14 is a cross-sectional view showing a watch band according to a modified embodiment (2) of the watch band shown in FIG. 11.

FIG. 14 is a cross-sectional view showing a watch band according to a modified embodiment (2) of the members of the watch band shown in FIG. 11. In this embodiment, as shown in the Figure, a decorative member 104 and a holding member 114, which are made of hard synthetic resin are integrated by the welding in the penetrating portion 26.

That is, the decorative member 104 comprises an upper portion corresponding to the front side recess portion 21, a lower portion corresponding to the approximately upper half of the penetrating portion 26 on a lower surface of the upper portion, and inserting portions 141 apart around the lower portion, which have a shape which projects downwardly and corresponds to insertion grooves 29 in the front side recess portion 21.

The holding member 114 comprises flange portions 114*a* in lower peripheral portions thereof corresponding to an approximately lower half portion of the penetrating portion 26, which have a shape corresponding to the rear side recess portion 27.

The decorative member 104 is fitted to the penetrating portion 26 from the front surface side of the band body 2, simultaneously, the inserting portions 141 are fitted to the insertion grooves 29.

The holding member 114 is fitted to the penetrating portion 26 from the rear surface side of the band body 2, simultaneously, the flange portions 114*a* are fitted to the rear side recess portion 27.

Thereafter, contacted surfaces between the decorative member 104 and the holding member 114 are joined to fix by the ultrasonic welding.

Accordingly, it is possible to sandwich the band body 2 around the penetrating portion 26, between the decorative member 104 and the holding member 114, which are made of hard synthetic resin. Therefore, because the decorative member 104 and the holding member 114 are integrated, it is possible to obtain a stable fixing force for decorative member 4 and it is possible to make it strong against a bending force, a twisting force or the like, of the band body 2.

Fifth Embodiment

Figure 15:
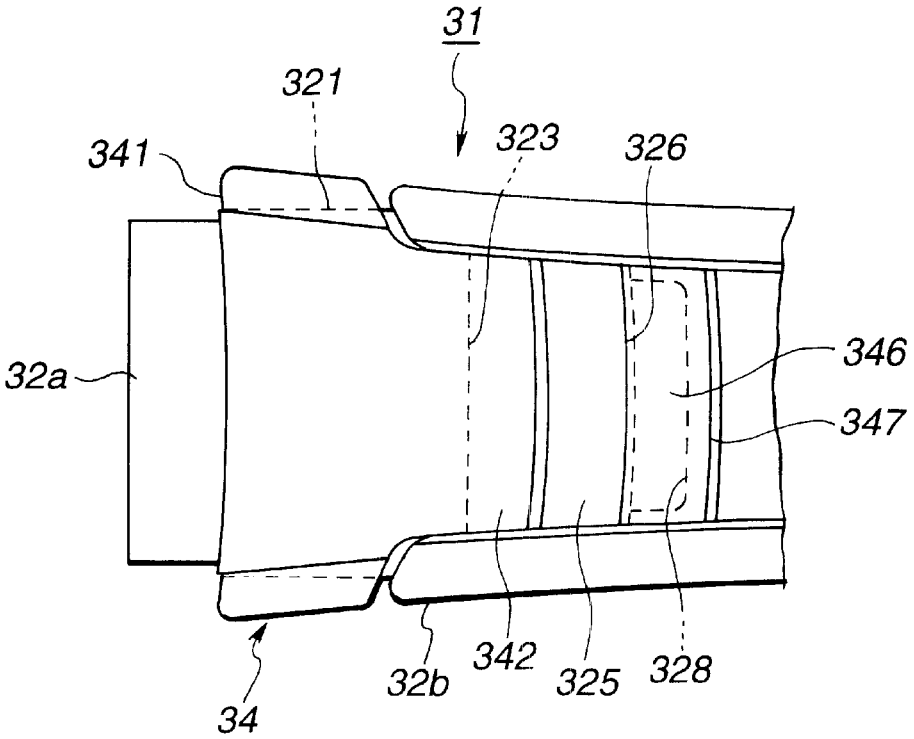
FIG. 15 is an enlarged plan view showing an attaching portion of a half body of a watch band, for attaching to the case complete according to the fifth embodiment of the invention.
Figure 16:
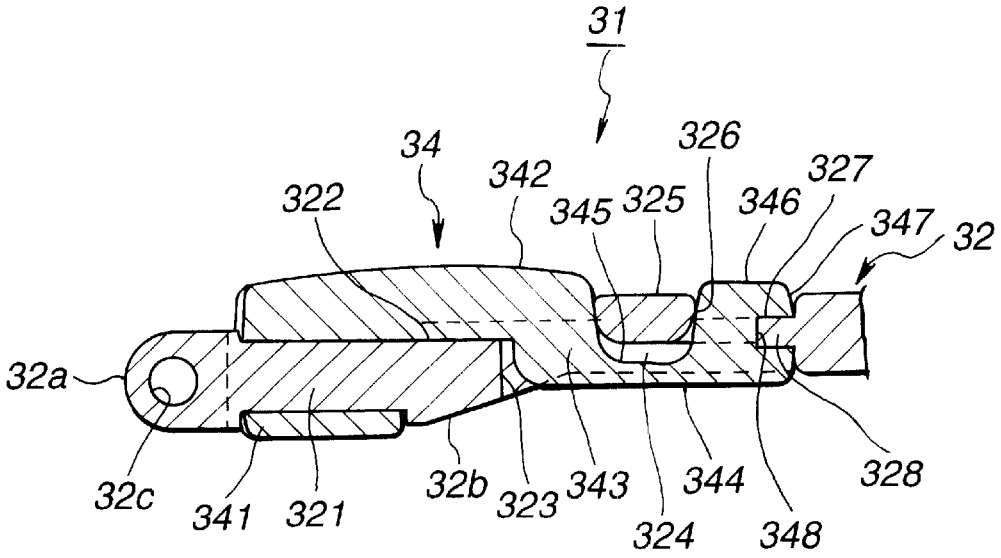
FIG. 16 is a central longitudinal cross-sectional view of FIG. 15.
Figure 17:
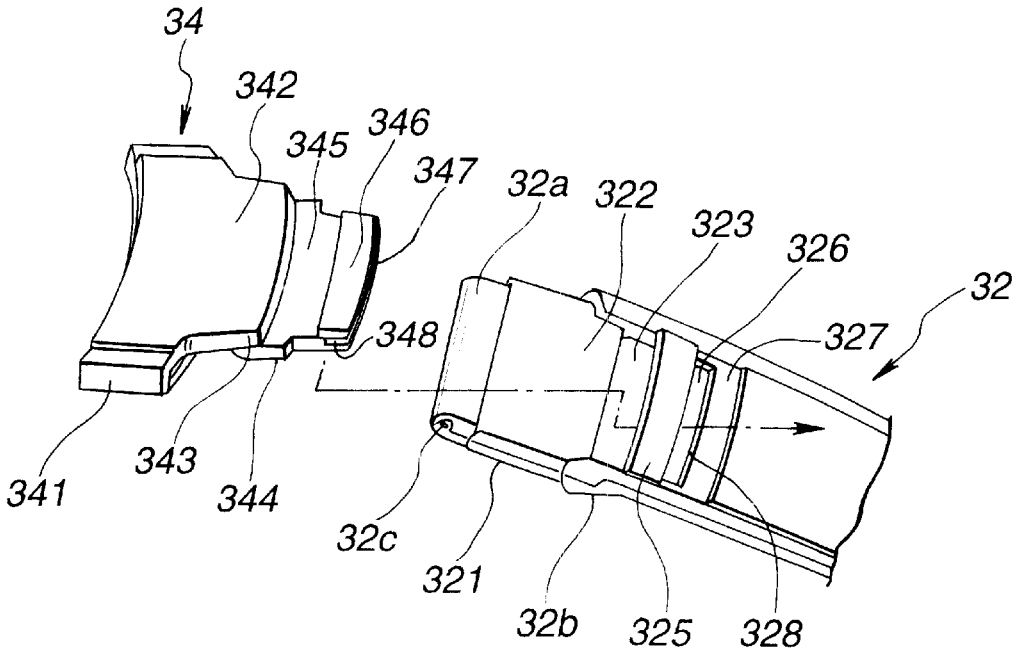
FIG. 17 is an exploded perspective view showing a way of attachment of a decorative member to a band body.

FIG. 15 is an enlarged plan view showing an attaching portion of a half body of a watch band, for attaching to the case complete according to the fifth embodiment of the present invention, and FIG. 16 is a central longitudinal sectional view thereof. FIG. 17 is an exploded perspective view showing a way of attaching a decorative member to a band body.

In FIGS. 15 to 17, reference numeral 31 denotes a watch band, reference numeral 32 denotes a band body which is made of soft synthetic resin, reference numeral 32*a* denotes an attaching boss for a case complete, reference numeral 32*b* denotes the attaching portion to the side of the case complete, reference numeral 32*c* denotes a screw through hole in the attaching boss 32*a*, reference numeral 321 denotes a neck portion, reference numeral 322 denotes a recess surface, reference numeral 323 denotes a penetrating portion, reference numeral 324 denotes a rear side recess portion, reference numeral 325 denotes a front side continuous portion in the front surface side, reference numeral 326 denotes a supplementary penetrating portion, reference numeral 327 denotes a front side recess portion, reference numeral 328 denotes a connecting projection, reference numeral 34 denotes a decorative member which is made of soft synthetic resin, reference numeral 341 denotes a loop-like portion, reference numeral 342 denotes a front surface portion, reference numeral 343 denotes an inserting portion, reference numeral 344 denotes a rear side thin portion in the rear surface side, reference numeral 345 denotes a front side recess portion, reference numeral 346 denotes an extending portion which is a tip inserting portion, reference numeral 347 denotes a front side flange portion, and reference numeral 348 denotes a connecting groove.

In this embodiment, as shown the Figures, the watch band 31 comprises the band body 32 which is made of soft synthetic resin. The band body 32 comprises the wide attaching portions 32*b* in a side of a case complete, not shown: the attaching boss 32*a* in the end portion, in which the screw through hole 32*c* is formed: the neck portion 321 which is narrow and thin near the attaching boss 32*a*: and the recess surface 322 which continues from the neck portion 321 to the front surface: wherein the penetrating portion 323 which continues to the recess surface 322 and penetrates through the band in the front and the rear directions of the band is formed in the band body 32.

The band body 32 further comprises the rear side recess portion 324 which continues to the penetrating portion 323, and the front side continuous portion 325 due to the existence of the rear side recess portion 324, wherein the supplementary penetrating portion 326 which continues to the rear side recess portion 324 and penetrates through the band in the front and the rear directions of the band is formed in the band body 32. The supplementary penetrating portion 326 is open in an inner direction of the front side recess portion 327 of which a portion facing to the front side continuous portion 325 forms the connecting projection 328.

The decorative member 34 which is made of soft synthetic resin comprises the loop-like portion 341 to which the neck portion 321 of the band body 32 is inserted, the front surface portion 342 which continues from the loop-like portion 341, and the inserting portion 343 which continues from the front surface portion 342 to the rear surface side. The inserting portion 343 has a shape which corresponds to the penetrating portion 323 of the band body 32.

The decorative member 34 further comprises the rear side thin portion 344 which continues to the inserting portion 343, the front side recess portion 345 due to an existence of the rear side thin portion 344, and the tip inserting portion 346 which is extending portion continuing from the rear side thin portion 344 to the front surface side. The tip inserting portion 346 comprises the front side flange portion 347 which corresponds to the front side recess portion 327 of the band body 32 and the connecting groove 348 which corresponds to the connecting projection 328 of the band body 32.

The neck portion 321 of the band body 32 is inserted to the loop-like portion 341 of the decorative member 34. As shown in FIG. 17 with arrow, the tip inserting portion 346 of the decorative member 34 is inserted to the penetrating portion 323 from the front surface side of the band body 32, thereafter, inserted to the supplementary penetrating portion 326 from the rear surface side.

Then, the connecting groove 348 is fitted to the connecting projection 328 at the supplementary penetrating portion 326.

The attachment of the decorative member 34 which is made of soft synthetic resin to the band body 32 which is made of soft synthetic resin is completed. In this completed state, as shown in the Figure, the inserting portion 343 is just fitted to the penetrating portion 323 and the front side flange portion 347 is just fitted to the front side recess portion 327 on the supplementary penetrating portion 326.

As above-described, because the decorative member 34 which is made of soft synthetic resin is attached to the band body 32 which is made of soft synthetic resin by press fitting, it is possible to easily obtain the watch band 31 which is made of soft synthetic resin and looks like a coinjection molding when mixing colors, of the band body 32 and the decorative member 34 are different from each other.

Further, not only the inserting portion 343 of the decorative member 34 is inserted to the penetrating portion 323 from the front surface side of the band body 32, but also the tip inserting portion 346 is inserted to the supplementary penetrating portion 326 from the rear surface side and the connecting groove 348 is fitted to the connecting projection 328. Accordingly, it is possible to prevent producing a space and turnover of the decorative member 34.

Sixth Embodiment

Figure 18:
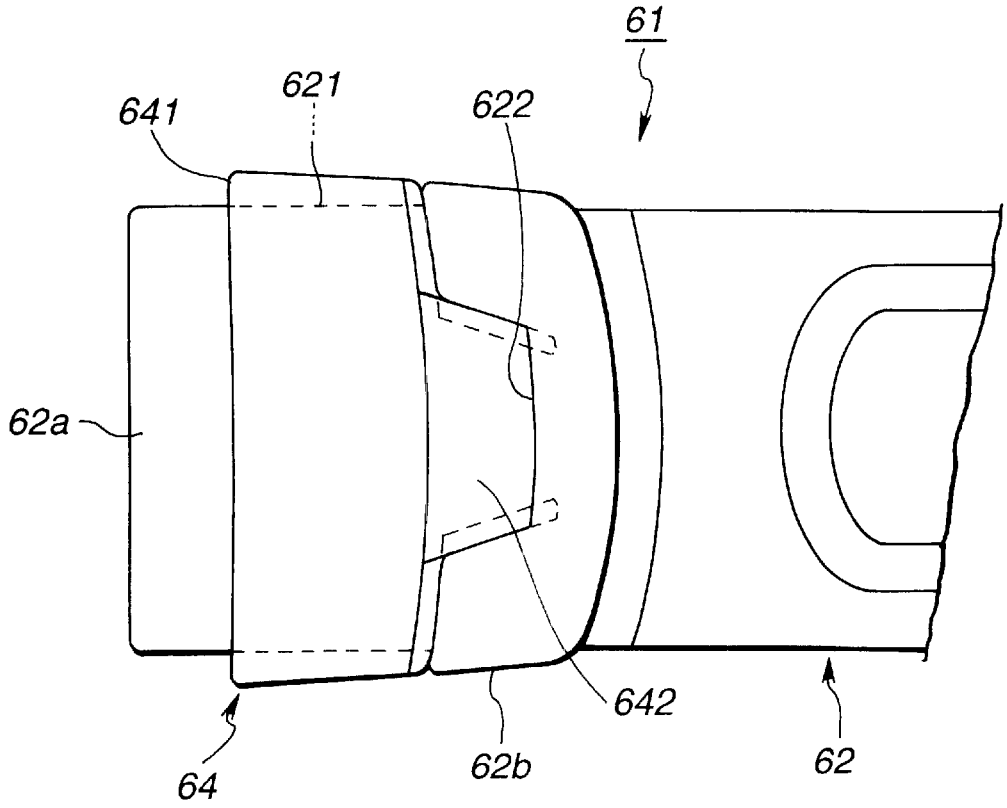
FIG. 18 is an enlarged plan view showing an attaching portion of a half body of a watch band, for attaching to the case complete according to the sixth embodiment of the invention.
Figure 19:
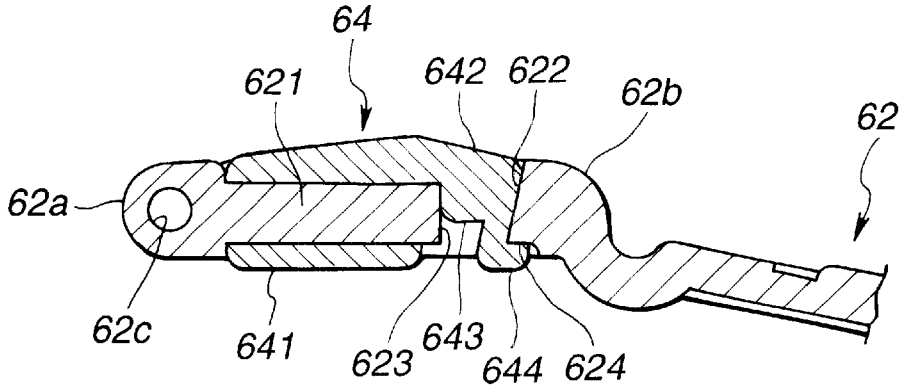
FIG. 19 is a central longitudinal cross-sectional view of FIG. 18.
Figure 20:
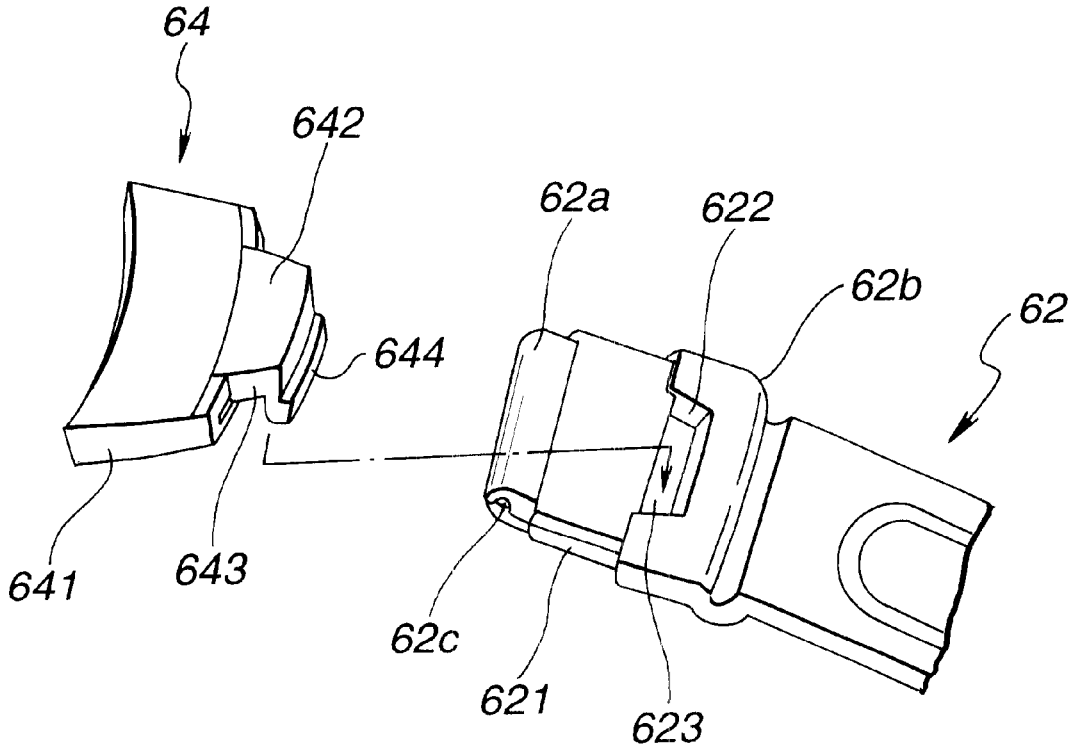
FIG. 20 is an exploded perspective view showing a way of attachment of a decorative member to a band body.

FIG. 18 is an enlarged plan view showing an attaching portion of a half body of a watch band, for attaching to the case complete according to the sixth embodiment of the present invention, and FIG. 19 is a central longitudinal sectional view thereof. FIG. 20 is an exploded perspective view showing a way of attaching a decorative member to a band body.

In FIGS. 18 to 20, reference numeral 61 denotes a watch band, reference numeral 62 denotes a band body which is made of soft synthetic resin, reference numeral 62*a* denotes an attaching boss for a case complete, reference numeral 62*b* denotes the attaching portion to the side of the case complete, reference numeral 62*c* denotes a screw through hole in the attaching boss 62*a*, reference numeral 621 denotes a neck portion, reference numeral 622 denotes a front side recess portion, reference numeral 623 denotes a penetrating portion, reference numeral 624 denotes a rear side connecting recess portion, reference numeral 64 denotes a decorative member which is made of soft synthetic resin, reference numeral 641 denotes a loop-like portion, reference numeral 642 denotes a front side projecting portion, reference numeral 643 denotes an inserting portion, and reference numeral 644 denotes a connecting projection.

In this embodiment, as shown in the Figures, the watch band 61 comprises the band body 62 which is made of soft synthetic resin. The band body 62 comprises the wide attaching portion 62*b* in the side of the case complete, not shown: the attaching boss 62*a* in the end portion, in which the screw through hole 62*c* is formed: the neck portion 621 which is narrow and thin near the attaching boss 62*a*: and the front side recess portion 622 which is central and continues from the neck portion 621: wherein the penetrating portion 623 which continues to the front side recess portion 622 and penetrates through the band in the front and the rear directions of the band is formed in the band body 62.

The band body 62 further comprises the rear side connecting recess portion 624 which continues to the penetrating portion 623.

A decorative member 64 which is made of soft synthetic resin comprises the loop-like portion 641 to which the neck portion 621 of the band body 62 is inserted, the front side projecting portion 642 which is central and continues from the loop-like portion 641, and the inserting portion 643 which continues from the front side projecting portion 642 to the rear surface side.

The front side projecting portion 642 has a shape which corresponds to the front side recess portion 622 of the band body 62. The inserting portion 643 has a shape which corresponds to the penetrating portion 623 of the band body 62.

The decorative member 64 further comprises the connecting projection 644 which corresponds to the rear side connecting recess portion 624 of the band body 62 at the tip of the inserting portion 643.

The neck portion 621 of the band body 62 is inserted to the loop-like portion 641 of the decorative member 64. Thereafter, as shown in FIG. 20 with arrow, the inserting portion 643 of the decorative member 64 is inserted to the penetrating portion 623 from the front surface side of the band body 62, simultaneously, the connecting projection 644 at a tip of the inserting portion 643 is fitted to the rear side connecting recess portion 624.

The attachment of the decorative member 64 which is made of soft synthetic resin to the band body 62 which is made of soft synthetic resin is completed. In this completed state, as shown in the Figure, the inserting portion 643 is just fitted to the penetrating portion 623 and the front side projecting portion 642 is just fitted to the front side recess portion 622 in the penetrating portion 623.

As above-described, because the decorative member 64 which is made of soft synthetic resin is attached to the band body 62 which is made of soft synthetic resin by press fitting, as the described fifth embodiment, it is possible to easily obtain the watch band 61 which is made of soft synthetic resin and looks like a coinjection molding when mixing colors, of the band body 62 and the decorative member 64 are different from each other.

Further, because the inserting portion 643 of the decorative member 64 is inserted to the penetrating portion 623 from the front surface side of the band body 62, and the connecting projection 644 at a tip of the inserting portion 643 is fitted to the rear side connecting recess portion 624, as the described fifth embodiment, it is possible to prevent producing a space and turnover of the decorative member 64.

In the fifth and the sixth embodiments, the mixing colors of the band bodies 32 and 62 and the decorative members 34 and 64 are different from each other, so that the watch bands 31 and 61 can be easily obtained, which are made of soft synthetic resin and looks like a coinjection molding. However, the material hardness of the band bodies and the decorative members may be varied.

As described above, by varying the material hardness of the band bodies and the decorative members, it is possible to improve feeling of fitting to a wrist and a strength of reinforcement as a watch band which is made of soft synthetic resin.

In each above-described embodiment, the fiber is made as a body by being surrounded by the band body which is made of soft synthetic resin. However, the present invention is not limited to this, for example, the band body can be made of only soft synthetic resin.

The design of each members or the like is also variable and the form and detail thereof can be suitably changed.

Seventh Embodiment

The band according to the seventh embodiment of the invention will be explained with reference to FIGS. 21 to 26 as follows.

Figure 21:
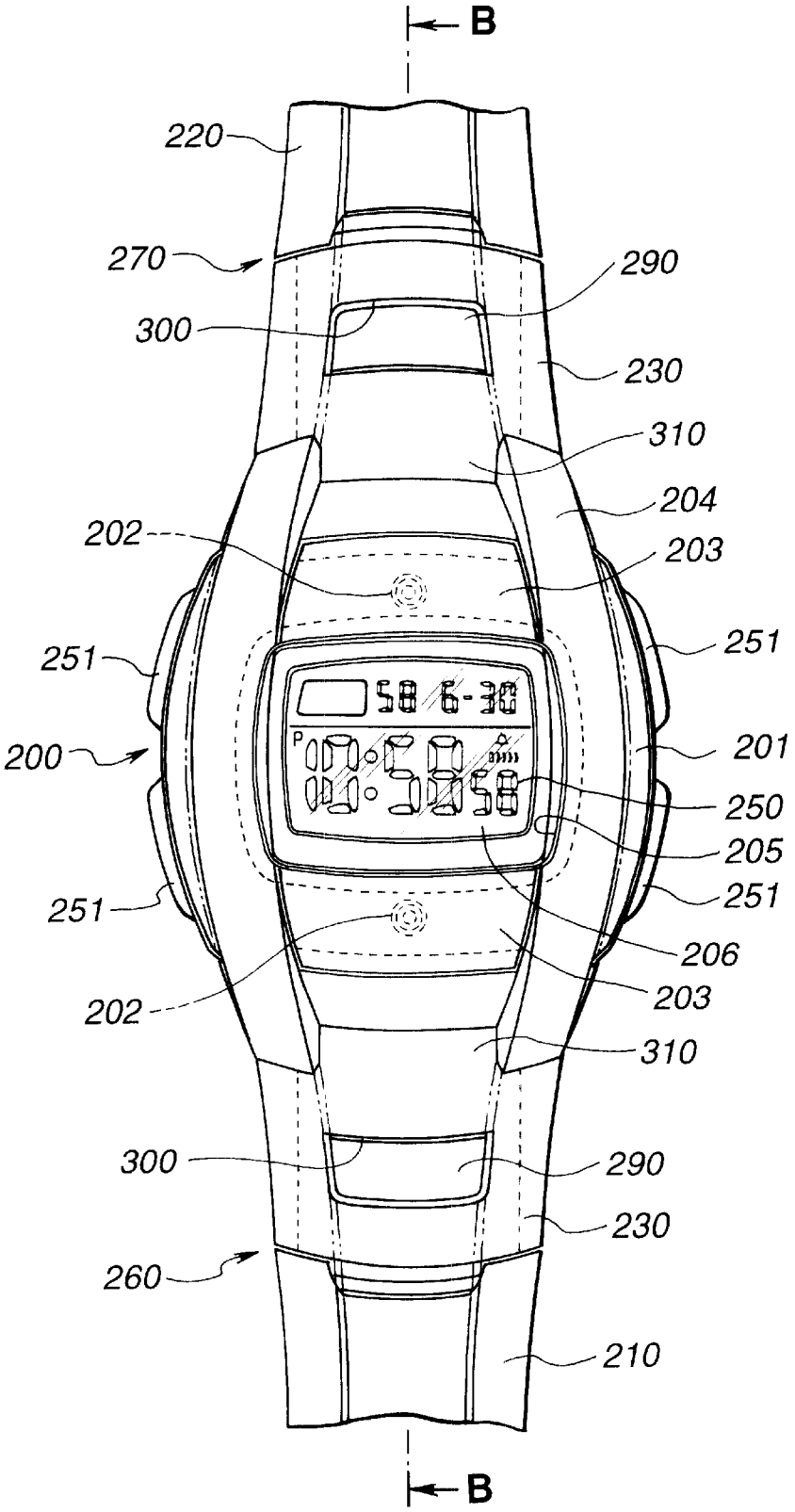
FIG. 21 is a front view showing a watch according to an example of the invention.
Figure 22:
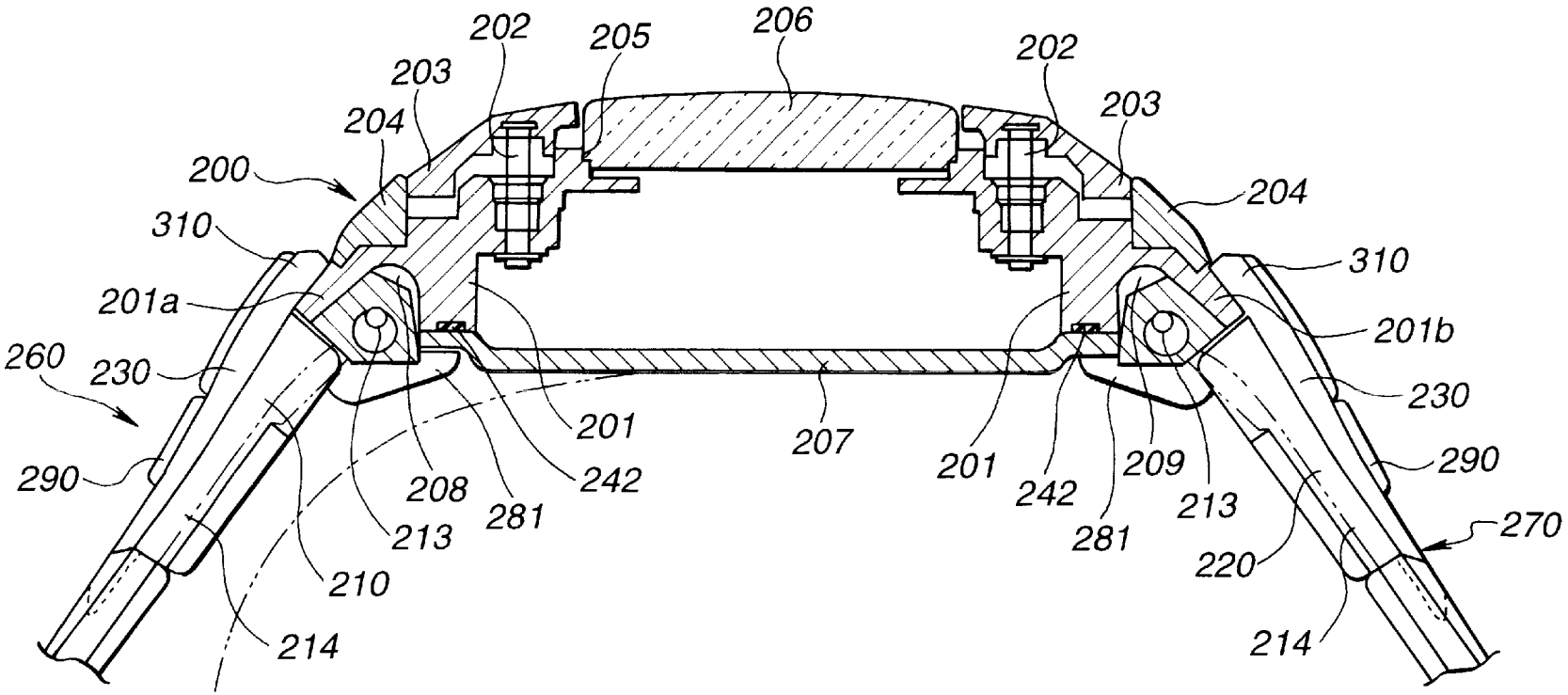
FIG. 22 is a cross-sectional view taken along the line B—B of FIG. 21.
Figure 23A:
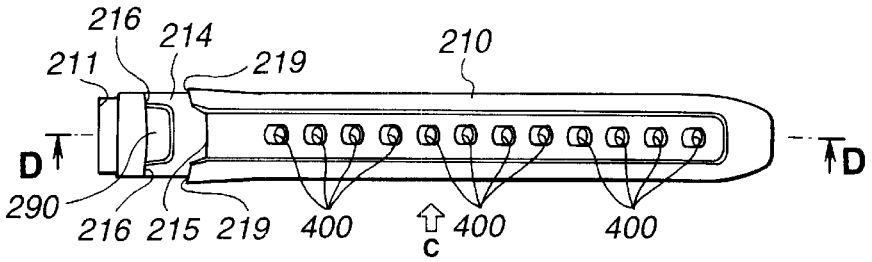
Figure 23B:
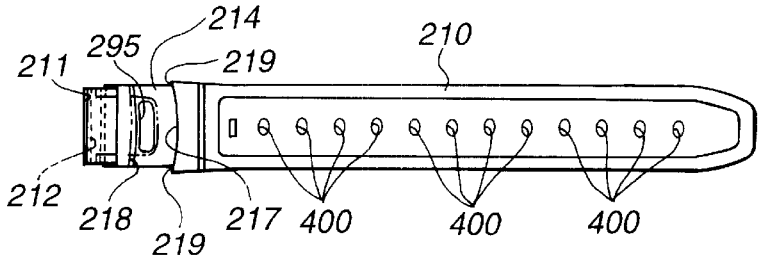
Figure 23C:
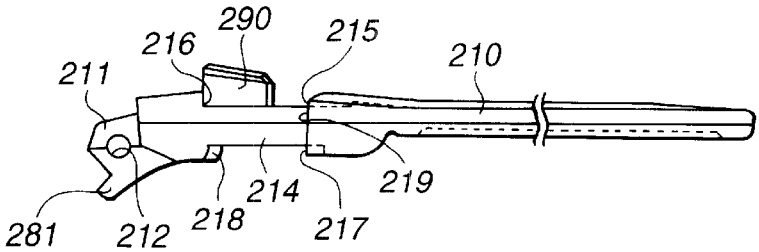
Figure 23D:
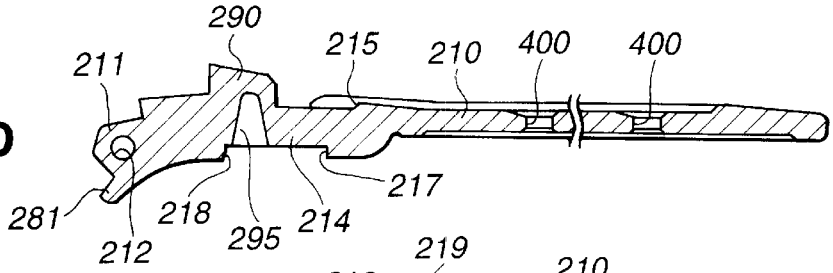
Figure 23E:
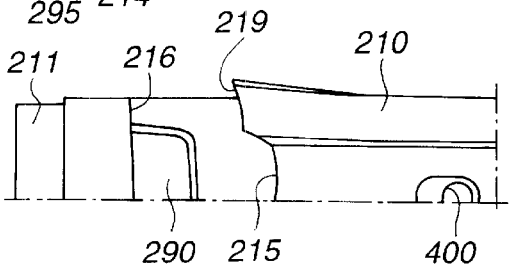
Figure 24A:
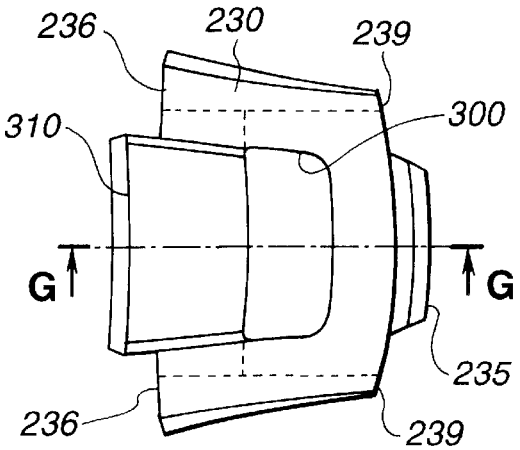
Figure 24D:
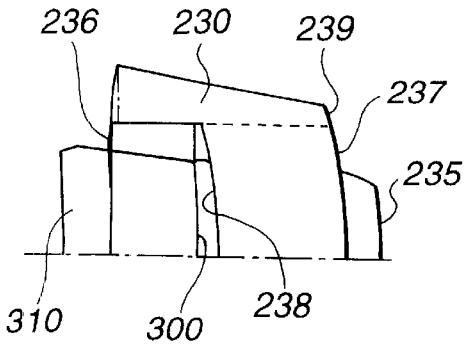
Figure 24B:
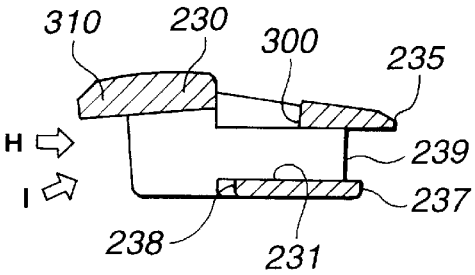
Figure 24E:
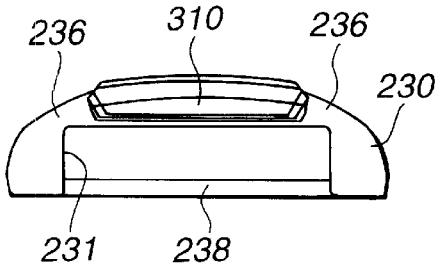
Figure 24C:
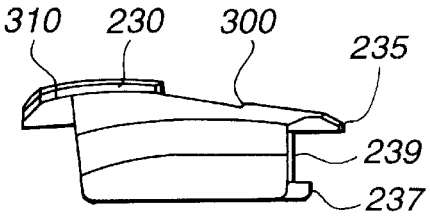
Figure 24F:
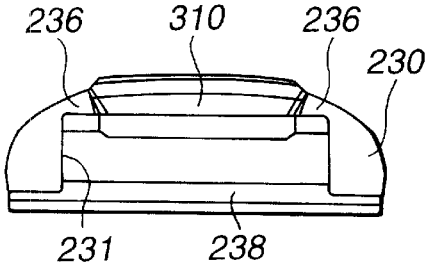
Figure 25A:
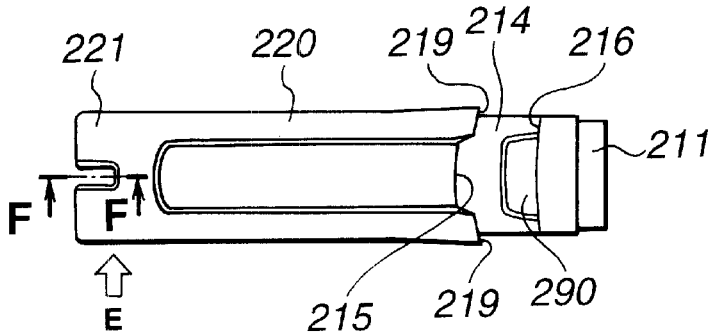
Figure 25B:
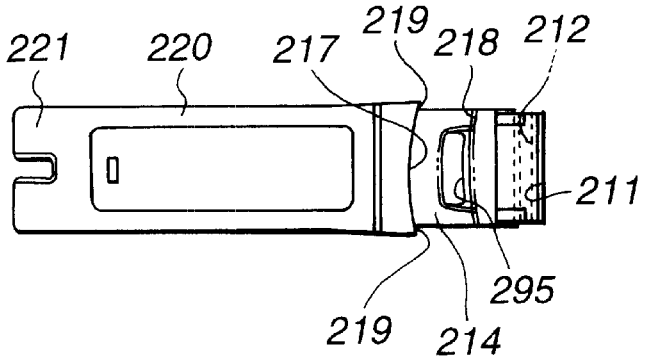
Figure 25C:
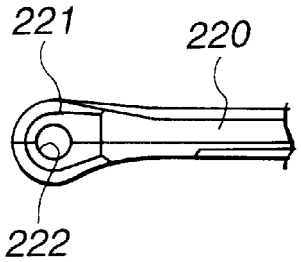
Figure 25D:
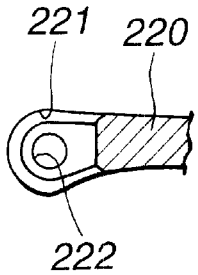
Figure 26:
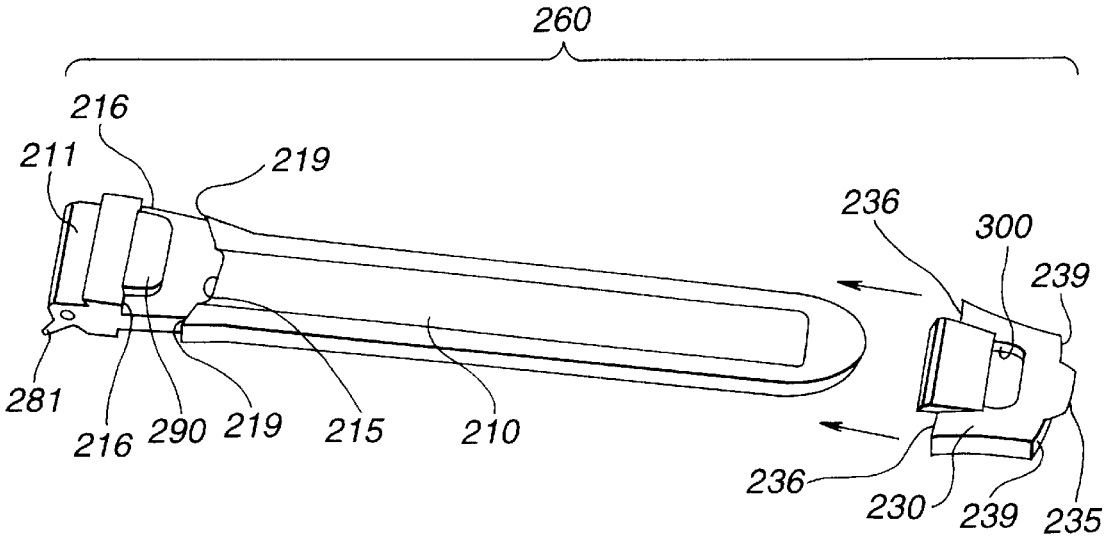
FIG. 26 is a perspective view showing an attachment of a decorative member to a band body.

FIG. 21 is a front view showing a watch according to an example of the present invention. FIG. 22 is a cross-sectional view taken along the line B—B of FIG. 21. FIGS. 23A to 23E show a band body which is attached to the case complete: wherein FIG. 23A is a plan view: FIG. 23B is a plan view of a rear side: FIG. 23C is a view taken in the direction of an arrow C of FIG. A: FIG. 23D is an enlarged cross-sectional view taken along the line D—D of FIG. 23A: and FIG. 23E is a partially enlarged view of FIG. 23A. FIGS. 24A to 24F show a decorative member: wherein FIG. 24A is a plan view: FIG. 24B is a cross-sectional view taken along the line G—G of FIG. 24A: FIG. 24C is a perspective view taken from oblique underside of FIG. 24A: FIG. 24D is a partial plan view of a rear side: FIG. 24E is a view taken in the direction of an arrow H of FIG. 24B: and FIG. 24F is a view taken in the direction of an arrow I of FIG. 24B. FIGS. 25A to 25D show another band body which is attached to the case complete: wherein FIG. 25A is a plan view: FIG. 25B is a plan view of a rear side: FIG. 25C is an enlarged view taken in the direction of an arrow E of FIG. 25A: and FIG. 25D is an enlarged cross-sectional view taken along the line F—F of FIG. 25A. FIG. 26 is a perspective view showing an attachment of a decorative member to a band body.

At first, based on FIGS. 21 and 22, rough structure of a watch 200 will be explained. As shown in FIGS. 21 and 22, an opening portion 205 is formed in an upper portion of a case complete 201 of the watch 200 and a glass 206 is mounted in the opening portion 205. A display portion 250 which displays the information such as time is disposed on a position which can be recognized from a front side of the watch 200 through the glass 206 and the opening portion 205. In an upper surface of the case complete 201, a bezel 204 is attached for protecting the case complete 201 from the shock in the front surface side. In the rear side of the case complete 201, a case back 207 is attached through a gasket 242, so that inner devices, not shown, which are contained in inside of the case complete 201 are protected.

The inner devices include a liquid crystal display device which displays information to be displayed on the display portion 250, a circuit board which performs the information processing or the like, of the information to be displayed on the liquid crystal display device, a luminous panel which functions as a back light of the liquid crystal display device, a battery which supplies electric power to these and other inner devices, or the like.

On the upper surface of the case complete 201, buttons 203 and 203 for carrying out various operations, such as luminescence of the luminous panel or the like are disposed. These buttons 203 and 203 are attached to the case complete 201 through switch members 202 and 202. As shown in FIG. 22, in rear surface sides of the buttons 203 and 203, one end of each switch members 202 and 202 is buried, while the other end of each switch members 202 and 202 is faced to an inner circumference side of the case complete 201 by penetrating to the case complete 201. When the buttons 203 and 203 are pressed, the buttons 203 and 203 go down against an elastic force of coil springs or the like, not shown, disposed in peripheries of the switch members 202 and 202. Then, the other ends of the switch members 202 and 202 act to a switch mechanism, not shown, disposed in the inner portion of the case complete 201, so that a predefined electrical signal is generated. On the other hand, when the pressing force to the buttons 203 and 203 is released, the buttons 203 and 203 are returned to an original position thereof by the elastic force of the coil springs.

Further, in side portions of the case complete 201, buttons 251 for carrying out various operations for setting the time or the like by pressing are disposed with the same mechanism as that of the buttons 203 and 203.

In one end of the case complete 201, a band attaching portion 208 is formed, thereto a band 260 is attached.

In the other end of the case complete 201, a band attaching portion 209 is formed, thereto a band 270 is attached.

The band 260 comprises a band body 210 and a decorative member 230 according to the present invention, which is attached to the band body 210, while the band 270 comprises a band body 220 and the decorative member 230 which is attached to the band body 220.

The watch 200 has the above-described structure.

The main purpose of this embodiment is to improve the unity between the case complete 201 and the bands 260 and 270 so that the watch 200 may have the harmonious design by covering a portion of the case complete 201 by the bands 260 and 270, that is, the band bodies 210 and 220 or the band bodies 210 and 220 and the decorative members 230 and 230.

A detailed structure of main elements according to the seventh embodiment of the present invention will be explained as follows.

In an upper portion of the band attaching portion 208 of the case complete 201, a projecting portion 201*a* is formed. In a state that the band 260 is attached to the case complete 201, the projecting portion 201*a* is put between an attaching boss 211 of the band body 210 (described later) and a covering portion 310 of the decorative member 230 (described later) and is covered by the covering portion 310 in appearance from the front side of the watch 200.

In an upper portion of the band attaching portion 209 of the case complete 201, a projecting portion 201*b* which is the same as the projecting portion 201*a* is formed.

The band body 210 is made of a flexible material, for example, soft synthetic resin or the like. As shown in FIG. 23, the attaching boss 211 for attaching the band body 210 to the case complete 201 is formed in one end side of the band body 210. In the attaching boss 211, an attaching hole 212 which penetrates thereto in wide direction of the band body 210 is formed. A spring bar 213 shown in FIG. 22 is inserted into the attaching hole 212, so that the band body 210 can be attached to the case complete 201.

On an under side of the attaching boss 211, a covering portion 281 projecting to a side of the case complete 201 is formed. In a state that the band body 210 is attached to the case complete 201, the covering portion 281 covers a part of case complete 201 from the under side thereof through a part of the case back 207 attached to the rear side of the case complete 201.

Further, an attaching portion 214 for attaching the decorative member 230 to the band body 210 is formed with neighboring the attaching boss 211.

The attaching portion 214 is formed thinner and narrower than the other portion of the band body 210, corresponding to a thickness of the decorative member 230 described in a later. This is for making the decorative member 230 approximately flush to the band bodies 210 and 220 when the decorative member 230 is attached to the attaching portion 214 by inserting the band bodies 210 and 220 to the decorative member 230.

On a front side of the attaching portion 214, a projecting portion 290 for positioning the decorative member 230 to the band body 210 is formed, while on a rear side of the attaching portion 214, which corresponds to the projecting portion 290, a recess portion 295 is formed. Accordingly, the thickness of a part of the attaching portion 214, on which the projecting portion 290 is formed is made not to be thicker than other portion of the band body 210.

In both ends of the front side of the attaching portion 214 of the band body 210 in the longitudinal direction of the band body 210, step-like portions 215, 216 and 216 are formed. In both ends of the rear side of the attaching portion 214 in the longitudinal direction, step-like portions 217 and 218 are formed. In side portions of the attaching portion 214, step-like portions 219 and 219 for making the step-like portion 215 and the step-like portion 217 continuous each other are formed.

The step-like portions 215, 216, 216, 217, 218, and 219 are for positioning the decorative member 230 to the band body 210 and preventing a slip and a rattling of the decorative member 230 in the longitudinal direction of the band body 210.

Along the longitudinal direction of the band body 210, holding holes 400 which penetrate the band body 210 in the front and the rear directions are formed at different positions each other. The holding holes 400 are for inserting a tongue 5*a* thereto, of a holder 5 attached to the band body 220 described in a later.

As shown in FIG. 25, the band body 220 is made of the elastic material of soft synthetic resin or the like and comprises the attaching boss 211 and the attaching portion 214, similarly the band body 210. Structural elements of the attaching boss 211 and the attaching portion 214 are corresponding to those of the band body 210, the same reference numerals are attached, and the detailed explanation for them is properly omitted.

The band body 220 is different from the band body 210 in other portions. In one end side of the band body 220, an attaching portion 221 for attaching the holder 5, for example, with the tongue 5*a*, as shown in FIG. 1 is formed. In the attaching portion 221, an attaching hole 222 is formed and the holder 5 is attached to the attaching hole 222. The attached state thereof is not shown.

The band body 220 is inserted to the loop 6 shown in FIG. 1.

The decorative member 230 is made of the elastic material of soft synthetic resin or the like. The decorative member 230 is attached to the band bodies 210 and 220 by sliding with elastic deforming, so that it is preferable that the decorative member 230 is more elastic than the band bodies 210 and 220. Further, it is preferable that colors of the decorative member 230 is different from that of the band bodies 210 and 220.

As shown in FIG. 24, the covering portion 310 according to the invention is formed in the decorative member 230. The covering portion 310 covers the projecting portions 201*a* and 201*b* formed in the case complete 201, when the band bodies 210 and 220 are attached to the case complete 201 with the decorative member 230 attached to the band bodies 210 and 220.

In the decorative member 230, the attaching hole 231 for attaching the decorative member 230 to the attaching portion 214 of the band bodies 210 and 220 is formed.

In the front side of the decorative member 230, an attaching hole portion 300 as a hole portion is formed for Positioning the decorative member 230 to the band bodies 210 and 220 by fitting the projecting portion 290 of the attaching portion 214 of the band bodies 210 and 220. In a state that the projecting portion 290 is fitted to the attaching hole portion 300, peripheries of the attaching hole portion 300 in the front side of the decorative member 230 and a front surface of the projecting portion 290 are made to be approximately flush.

When the decorative member 230 is attached to the attaching portion 214 of the band bodies 210 and 220, among end surfaces in the longitudinal direction of the band bodies 210 and 220, an end surface 235 is in contact with the step-like portion 215 of the attaching portion 214 of the band bodies 210 and 220. Similarly, end surfaces 236 and 236 are in contact with the step-like portions 216 and 216, an end surface 237 is in contact with the step-like portion 217, an end surface 238 is in contact with the step-like portion 218, and an end surface 239 is in contact with the step-like portion 219. It is described that each end surface 235, 236, 236, 237, 238, and 239 is in contact with each step-like portion 215, 216, 216, 217, 218, and 219, practically, it may be possible to have a small space, that is, play between them.

When the decorative member 230 is attached to the attaching portion 214 of the band bodies 210 and 220, the decorative member 230 has a thickness to be approximately flush with the band bodies 210 and 220. Accordingly, when the decorative member 230 is attached to the attaching portion 214, the decorative member 230 is approximately flush with the band bodies 210 and 220.

Then, the decorative member 230 can be attached to fit in the attaching portion 214 of the band bodies 210 and 220.

An attachment of the decorative member 230 to the band body 210 will be explained as follows.

As shown in FIG. 26, the band body 210 is inserted to the attaching hole 231 of the decorative member 230 in the direction of the arrow in the Figure and the decorative member 230 is elastically deformed, so that the projecting portion 290 of the band body 210 is fitted in the attaching hole portion 300 of the decorative member 230. Accordingly, the decorative member 230 is positioned to the band body 210.

In this state, the end surface 235 of the decorative member 230 is in contact with the step-like portion 215 of the attaching portion 214 of the band bodies 210 and 220, the end surfaces 236 and 236 are in contact with the step-like portions 216 and 216, the end surface 237 is in contact with the step-like portion 217, the end surface 238 is in contact with the step-like portion 218, and the end surface 239 is in contact with the step-like portion 219. Accordingly, the decorative member 230 is also positioned to the band body 210 by the contact between the end surfaces 235, 236, 236, 237, 238, and 239 and the step-like portions 215, 216, 216, 217, 218, and 219.

Further, because the attaching portion 214 of the band body 210 is formed thin and narrow, corresponding to the thickness of the decorative member 230 and the peripheries of the attaching hole portion 300 in the front side of the decorative member 230 are approximately flash with the upper surface of the projecting portion 290 of the band body 210, the decorative member 230 is approximately flash with the band body 210.

An attachment of the decorative member 230 to the band body 220 is the same as that above-described. The decorative member 230 is similarly positioned to the band body 220 and approximately flash with the band body 220.

Next, an attachment of the band bodies 210 and 220, that is, the bands 260 and 270 to the case complete 201 will be explained as follows.

At first, the spring bar 213 is inserted into the attaching hole 212 of the attaching boss 211 of the band body 210 to which the decorative member 230 is attached. Then, the band body 210, that is, the band 260 is attached to the band attaching portion 208 of the case complete 201 in a rotatable state about the spring bar 213.

In the state, the projecting portion 201*a* of the case complete 201 is covered with the covering portion 310 of the decorative member 230, while the portion of the case complete 201 is covered with the covering portion 281 formed in the under side of the attaching boss 211 of the band body through the end portion of the case back 207 attached to the rear side of the case complete 201.

An attachment of the band body 220, that is, the band 270 to the attaching portion 209 of the case complete 201 is the same as that above-described. In the state that the band body 220 is attached to the band attaching portion 209, the projecting portion 201*b* of the case complete 201 is covered with the covering portion 310 of the decorative member 230, while the end portion of the case back 207 attached to the rear side of the case complete 201 is covered with the covering portion 281 formed in the under side of the attaching boss 211 of the band body.

Accordingly, it is possible to conceal the spaces in the attaching portions of the band bodies 210 and 220, that is, the bands 260 and 270 to the case complete 201 by the covering portions 310 of the decorative members 230 and covering portions 281 and 281 formed in the under side of the attaching bosses 211 of the band bodies 210 and 220.

In the state that the band bodies 210 and 220, that is, the bands 260 and 270 are attached to the case complete 201, as shown in FIG. 22, the covering portions 310 and 310 of the decorative members 230 and 230 and the covering portions 281 and 281 of the band bodies 210 and 220 are approximately flush with the peripheral portions of the covering portions 310, 310, 281 and 281.

According to the seventh embodiment of the invention, it is possible to conceal the spaces in the attaching portions between the band bodies 210 and 220, that is, the bands 260 and 270 and the case complete 201 by the covering portions 310 of the decorative members 230 and covering portions 281 and 281 formed in the under side of the attaching bosses 211 of the band bodies 210 and 220.

Therefore, it is possible to make the watch 200, that is, the wrist device have a high harmonious design between the case complete 201 and the bands 260 and 270 without being conscious the joints between them, so that it is possible to obtain the unity of the watch 200.

Further, because the decorative members 230 and 230 are attached to the band bodies 210 and 220, it is possible to decorate the band bodies 210 and 220 by them.

Because the attaching portions 214 of the band bodies 210 and 220 are formed thin and narrow, corresponding to the thickness of the decorative members 230 and 230, and the peripheral portions of the attaching hole portions 300 and 300 in the front side of the decorative members 230 and 230 are approximately flush with the front surfaces of the projecting portions 290 and 290 of the band bodies 210 and 220, the decorative members 230 and 230 are approximately flush with the band bodies 210 and 220.

Accordingly, it is possible to improve the unity of the decorative members 230 and 230 to the band bodies, so that the watch 200 can have higher harmonious design. Further, it is possible to fit the decorative members 230 and 230 to the band bodies 210 and 220 and to prevent the turnover of the decorative members 230 and 230 against the band bodies 210 and 220.

By fitting the projecting portions 290 and 290 formed in the attaching portions 214 and 214 of the band bodies 210 and 220 to the attaching hole portions, that is, hole portions 300 formed in the decorative members 230 and 230, the decorative members 230 and 230 are positioned to the band bodies 210 and 220. Accordingly, it is suitably possible to prevent the slip and the rattling of the decorative members 230 and 230 against the band bodies 210 and 220.

Because in the rear side portions corresponding to the projecting portions 290 of the attaching portions 214 and 214 of the band bodies 210 and 220, the recess portions 295 and 295 are formed, the thickness of the portion of the attaching portions 214 and 214, on which the projecting portions 290 and 290 are formed, are made to be not much thicker than other portions of the band bodies 210 and 220. Accordingly, in the state that the decorative members 230 and 230 are attached to the band bodies 210 and 220, it is possible that the portions of the band bodies 210 and 220, corresponding to the projecting portions 290 and 290, have approximately the same easiness of flexibility as that of the peripheries of other portions of the band bodies 210 and 220.

Therefore, it is possible to wear the watch 200 to the wrist by the bands 260 and 270 without feeling a sense of incongruity and to make the feelings to wear the watch 200 pleasant.

By making the colors, of the band bodies 210 and 220 and the decorative members 230 and 230 different from each other, it is possible to obtain the design which looks like that the band bodies 210 and 220 and the decorative members 230 and 230 are made by a coinjection molding.

Further, because the covering portions 310 and 310 of the decorative members 230 and 230 and the covering portions 281 and 281 of the attaching bosses 211 and 211 of the band bodies 210 and 220 are approximately flash with the peripheral portions of the covering portions 310, 310, 281 and 281, it is possible to have a design which does not induce the consciousness of boundaries between the covering portions 310, 310, 281 and 281 and the peripheral portions thereof. Accordingly, it is possible to further improve the unity between the band bodies 210 and 220, that is, the bands 260 and 270 and the case complete 201 and to obtain the higher harmonious feelings with the watch 200.

In the above-described seventh embodiment, the watch is explained as a wrist device. However, as the wrist device, it may be another device which is used by wearing to the wrist with bands, for example, a compass, a water depth gauge, or the like.

In the embodiment, the decorative members 230 and 230 are attached to the band bodies 210 and 220, however, the decorative member is not always required. In the case that the decorative member is not used, a covering portion is formed in the band body, thereby a portion of the case complete may be covered.

Although the projecting portions 201*a* and 201*b* are formed in the case complete 201 and positioned between the attaching bosses 211 and 211 of the band bodies 210 and 220 and the covering portion 310 and 310 of the decorative members 230 and 230, the projecting portions 201*a* and 201*b* are not always required.

Although the projecting portions 290 of the band bodies 210 and 220 are fitted in the attaching hole portions 300 of the decorative members 230, a recess portion may be formed in the decorative member 230 so that the projecting portion 290 may be fitted thereto.

Although the decorative members 230 and 230 are attached to the band bodies 210 and 220 by that the band bodies 210 and 220 are inserted into the decorative members 230 and 230, the decorative member may be attached to the band body by adhering, welding or the like. In these cases, the forms or shapes, of the decorative member and the band body may be suitably changed.

The design of each members or the like is also variable and the form and detail thereof can be suitably changed.

As above-described, according to an embodiment of the invention, a band (1) comprises: a band body (2) in which a pair of insertion portions (for example, insertion holes 23) are formed apart from each other and a recess portion (24) which is opened to a rear surface side of the band between the pair of insertion portions is formed; a decorative member (4) comprising a pair of inserting portions (42) which are inserted into the pair of insertion portions of the band body from a front surface side of the band; and a bar-like member (8) bridged between the pair of inserting portions of the decorative member at the recess portion of the band body from the rear surface side of the band.

The decorative member is, for example, disposed to the band body in the vicinity of the attaching portion for the case complete.

The band body is, for example, made of soft synthetic resin.

The decorative member is, for example, made of metal.

The bar-like member is, for example, a spring bar.

The pair of insertion portions are, for example, formed apart from each other in the width direction of the band. However, the position of the pair of insertion portions can be varied, for example, the pair of insertion portions can be formed apart form each other in a longitudinal direction of the band. Further, the pair of insertion portions can be insertion holes which penetrate through the band in the front and the rear directions, and which can also be a pair of recess portions which are not penetrate therethrough.

According to the embodiment of the invention, the pair of inserting portions of the decorative member is inserted to the insertion portions formed in the band body from the front surface side of the band body, and the bar-like member is bridged the pair of inserting portions in the recess portion which is opened to the rear surface side of the band between the pair of insertion holes of the band body. Accordingly, because the pair of inserting portions of the decorative member are inserted to the band body, thereafter the bar-like member is bridged the pair of inserting portions in the recess portion in the rear surface side, it is possible to certainly attach the decorative member to the band body, with relatively plain structure. Therefore, it is possible to hold the band body and the decorative member in a state of being certainly attached to each other without metal insert molding, and it is possible to improve the aesthetic appearance of the band.

According to another embodiment of the invention, the band further comprises a covering member (9) contained in the recess portion (24) and covering at least a portion of a periphery of the bar-like member (8).

The covering member is, for example, made of hard synthetic resin.

According to another embodiment of the invention, because the covering member covering at least the portion of the periphery of the bar-like member is contained in the recess portion of the band, it is possible to cover at least the portion of the bar-like member in the recess portion in the rear surface side of the band by the covering member.

According to another embodiment of the invention, a band (1) comprises: a band body (2) in which a penetrating portion (26) penetrating in front and rear directions of the band is formed; a decorative member (4) inserted into the penetrating portion of the band body from a front surface side of the band; a holding member (13) inserted into the penetrating portion of the band body from a rear surface side of the band to hold the decorative member; and a securing portion (for example, a peripheral insertion groove 22 or a rectangular rear side recess portion 27) securing the decorative member and the holding member to the band body.

The decorative member is, for example, disposed to the band body in the vicinity of the attaching portion for the case complete.

According to the another embodiment of the invention, the decorative member is inserted to the penetrating portion of the band body, which penetrates in the front and the rear direction of the band from the front surface side of the band, and the holding member is inserted to the penetrating portion of the band body in the rear surface side of the decorative member, thereafter the holding member and the decorative member are secured to the band body by the securing portion. Accordingly, because the decorative member and the holding member, which are inserted to the penetrating portion of the band body from the front and the rear sides, respectively, are secured to the band body around the penetrating portion, it is possible to certainly attach the decorative member to the band body, with relatively plain structure.

Further, because the decorative member and the holding member are secured to the band body around the penetrating portion, it is possible to prevent a rattling of the decorative member.

Therefore, it is possible to hold the band body and the decorative member in a state of being certainly attached to each other without metal insert molding, to prevent a rattling of the decorative member, and to improve the aesthetic appearance of the band.

In the case of above-described another embodiment, the decorative member (4) and the holding member (13) can be joined to be integrated.

For joining, for example, adhering by an adhering member, for example, a double coated member, or welding, for example, welding by ultrasonic or the like can be used.

According to the another embodiment of the invention, because the decorative member and the holding member are integrated by joining, it is possible to obtain a stable joining force between the decorative member and the holding member. Further, when the decorative member and the holding member are rigid bodies, deformation, of the decorative member and the holding member by a bending force, a twisting force or the like, of the band body, for example, made of soft synthetic resin is small.

In the case of above-described another embodiment, the holding member (13) can comprise the rear side member (14) which is inserted to the penetrating portion (26) of the band body (2) from the rear surface side, the front side member (15) which is inserted to the penetrating portion from the front surface side; and the rear side member and the front side member can be integrated in a state that a portion of the band body is sandwiched between the rear side member and the front side member.

The rear side member and the front side member are integrated by, for example, adhering or joining.

According to the another embodiment of the invention, the holding member sandwiches a portion of the band body around the penetrating portion, between the rear side member fitted from the rear surface side of the band and the front side member fitted from the front surface side of the band, in this state, the rear side member and the front side member are integrated. Therefore, because it is difficult to transmit a bending force, a twisting force or the like, of the band body to the decorative member, it is possible to obtain a more stable fixing force for decorative member.

In the case of above-described another embodiment, the band body (2) can be made of soft synthetic resin and the decorative member (4) can be made of metal or synthetic resin.

According to the another embodiment of the invention, because the band can have the band body which is made of soft synthetic resin and the decorative member which is made of metal or synthetic resin, it is possible to certainly attach the decorative member which is made of metal or synthetic resin to the band body which is made of soft synthetic resin, with relatively plain structure, and to prevent the rattling of the decorative member.

According to another embodiment of the invention, a band (31 or 61) comprises: a band body (32 or 62) in which a penetrating portion (323 or 623) penetrating in front and rear directions of the band is formed; and a decorative member (34 or 64) inserted in the penetrating portion of the band body, wherein one end portion of the decorative member is engaged to one end side of the band body; and the other end portion of the decorative member is engaged to the other end side of the band body.

The decorative member is, for example, disposed to the band body in the vicinity of the attaching portion for the case complete.

According to the another embodiment of the invention, the decorative member is inserted into the penetrating portion of the band body, which penetrates in the front and the rear side of the band; one end portion of the decorative member is engaged to one end side of the band body, and the other end portion of the decorative member is engaged to the other end side of the band body. That is, the decorative member is inserted into the penetrating hole of the band body, thereafter, it is engaged to the band body by one end portion and the other end portion. Accordingly, it is possible to certainly attach the decorative member to the band body, with relatively plain structure.

Therefore, it is possible to obtain the unity of the band with the band body having the decorative member like a coinjection molding without a space and turnover, and to improve the aesthetic appearance of the band.

In the case of the another embodiment, the band body (32) in which a supplementary penetrating portion (326) can be formed at a position which is different from a position of the penetrating portion (323); the decorative member (34) can comprise a connecting portion (348) in the other end portion; and the connecting portion can be engaged to the supplementary penetrating portion.

According to the another embodiment of the invention, because the connecting portion in the other end portion of the decorative member is engaged to the supplementary penetrating portion of which the position is different from the position of the penetrating portion of the band body, it is possible to certainly prevent producing a space and turnover of the decorative member.

In the case of the above-described another embodiment, the decorative member (64) can comprise the connecting portion (644) in the other end portion; a connecting recess portion or a connecting projecting portion (for example, the connecting recess portion 624) can be formed in the penetrating portion (623) in the rear surface side of the band; and the connecting portion of the decorative member can be engaged to the connecting recess portion or the connecting projecting portion.

According to the another embodiment of the invention, the connecting portion in the other end portion of the decorative member can be engaged to the connecting recess portion or the connecting projecting portion which can be formed in the penetrating portion of the band body in the rear surface side of the band. Accordingly, because connecting portion of the decorative member which is inserted to the penetrating portion from the front surface side of the band can be engaged to the connecting recess portion or the connecting projecting portion of the penetrating portion of the band body in the rear surface side of the band, it is possible to certainly prevent producing a space and turnover of the decorative member.

According to further embodiment of the invention, the wrist device (for example, the watch 200) comprises: the case complete (201); and the band (260 and 270, for example, the band comprises the band body 210 and 220 and the decorative member 230 and 230 attached to the band body) attached to the case complete and comprising the covering portion (for example, a covering portion 310 formed in a decorative member 230, and covering portions 281 and 281 formed in band bodies 210 and 220); wherein the portion of the case complete is covered with the covering portion.

For the wrist device, it includes all devices for being worn on the wrist, having a band for a watch, a compass, a water depth gauge, or the like.

In the rear side of the case complete, a case back can be attached, however, the covering portion can cover the case complete in the state that the case back is placed between the covering portion and the case complete.

According to the further embodiment of the invention, because the portion of the case complete is covered with the covering portion which is formed in the band, it is possible to conceal the spaces in the attaching portions for the case complete, of the band bodies by the covering member.

Therefore, it is possible to make the wrist device have a high harmonious design between the case complete and the bands without being conscious the joints between them, so that it is possible to obtain the unity of the wrist device.

According to another embodiment of the invention, the wrist device (for example, the watch 200) comprises: the case complete (201); and the band comprising the band body (210 and 220) attached to the case complete, and the decorative member (230 and 230) attached to the band body and comprising the covering portion (310 and 310); wherein the portion of the case complete is covered with the covering portion.

For the wrist device, it includes all devices for being worn on the wrist, having a band for a watch, a compass, a water depth gauge, or the like.

In the rear side of the case complete, a case back can be attached, however, the covering portion can cover the case complete in the state that the case back is placed between the covering portion and the case complete.

For the decorative member, for example, the one which is made of a material having flexibility to be attached to the band body by that the band body is inserted into the decorative member, or which is secured to a one side or both sides of the band body by adhering, welding or the like can be applied.

According to the another embodiment of the invention, because the decorative member is attached to the band body, it is possible to decorate the band body by the decorative member. Further, because the portion of the case complete is covered with the covering portion which is formed in the decorative member, it is possible to conceal the spaces in the attaching portions for the case complete, of the band bodies by the covering portion. Accordingly, it is possible to make the wrist device have a high harmonious design between the case complete and the band bodies without being conscious the joints between them. Therefore, it is possible to obtain the unity of the wrist device.

In the case of the above-described another embodiment, the decorative member (230) can be approximately flush with the band body (210 and 220).

For making the decorative member approximately flush with the band body, in the case that the decorative member is made of the material having flexibility to be attached to the band body by that the band body is inserted into the decorative member, the attaching portion of the band body, to which the decorative member is attached is made thinner or narrower compared with other portion of the band body, according to the thickness of the decorative member.

In the case that the decorative member is secured to a one side or both sides of the band body by adhering, welding or the like, for making the decorative member approximately flush with the band body, the attaching portion of the band body, to which the decorative member is attached is made thinner compared with other portion of the band body, according to the thickness of the decorative member, or the attaching portion is formed to be a recess portion.

According to the another embodiment of the invention, because the decorative member is approximately flush with the band body, it is possible to improve the unity of the decorative member and the band body.

Further, it is possible to make the decorative member fit to the band body, so that it is possible to prevent the turnover of the decorative member from the band body.

In the case of the another embodiment, the band body (210 and 220) can comprise a projecting portion (290 and 290), a recess portion or a hole portion (for example, the attaching hole portions 300 and 300) can be formed in the decorative member (230 and 230), and the decorative member can be positioned to the band body by inserting the projecting portion to the recess portion or the hole portion.

According to the another embodiment of the invention, because the decorative member is positioned to the band body by that the projecting portion which is formed in the band body is inserted to the recess portion or the hole portion which is formed in the decorative member, it is possible to suitably prevent the slip and the rattling, of the decorative member against the band body.

In the case of the another embodiment, the portion of the band body (210 and 220), corresponding to the projecting portion (290 and 290) and the periphery thereof have approximately the same easiness of flexibility in the state that the decorative member (230 and 230) is attached to the band body.

In the case that the decorative member is attached to the band body by that the band body is inserted into the decorative member, for the purpose of easy attaching of the decorative member, the decorative member may be made of a material which is more flexible compared with the band body. In this case, when the decorative member is attached to the band body and approximately flush with the band body, the portion corresponded to the projecting portion is difficult to bend compared to other portion, because the band body which is made rigid material compared to the decorative member is thick. Accordingly, there is the feeling a sense of incongruity when the wrist device is worn to the wrist by the band, t hat is, the one having the band body to which the decorative member is attached.

For obtaining more pleasant feelings to wear the wrist device by the band, it is required to make the portions of the band body, corresponding to the projecting portion have the same easiness of flexibility as that of the peripheries of other portions.

For making the portions of the band body, corresponding to the projecting portion have the same easiness of flexibility as that of the peripheries of other portions, for example, the recess portion is formed in the rear side of the projecting portion of the band body so that it may make the thickness the portions of the band body, corresponding to the projecting portion thin.

According to the another embodiment of the invention, because the portion of the band body, corresponding to the projecting portion has approximately the same easiness of flexibility as that of the peripheries of other portions of the band body in the state of attaching the decorative member to the band body, it is possible to wear the wrist device to the wrist by the band without feeling the sense of incongruity and to make the feelings to wear the wrist device pleasant.

In the case of the another embodiment, the colors, of the band body (210 and 220) and the decorative member (230 and 230) can be different from each other.

By making the colors, of the band body and the decorative member different from each other, it is possible to obtain the design which looks like that the band body and the decorative member are made by a coinjection molding.

In the case of above-described another embodiment, the covering portion (310 and 310) can be approximately flush with a peripheral portion thereof.

According to the another embodiment of the invention, because the covering portion is approximately flush with the peripheral portion thereof, it is possible to make the wrist device have such design as not to be conscious the joints between the covering portion and the peripheral portion thereof. Therefore, it is possible to improve the unity of the band or band body and the case complete, so that it is possible to obtain higher unity of the wrist device.

As above-described, according to the band of the invention claimed in claim 1, because the pair of inserting portions of the decorative member are inserted to the band body, thereafter the bar-like member is bridged the pair of inserting portions in the recess portion in the rear surface side, it is possible to certainly attach the decorative member to the band body, with relatively plain structure. Therefore, it is possible to hold the band body and the decorative member in a state of being certainly attached to each other without metal insert molding, and it is possible to improve the aesthetic appearance of the band.

According to the band of the invention claimed in claim 2, in addition to the effect obtained by the invention claimed in claim 1, it is possible to cover at least the portion of the bar-like member in the recess portion in the rear surface side of the band by the covering member.

According to the band of the invention claimed in claim 3, because the decorative member and the holding member, which are inserted to the penetrating portion of the band body from the front and the rear sides, respectively, are secured to the band body, it is possible to certainly attach the decorative member to the band body, with relatively plain structure.

Further, because the decorative member and the holding member are secured to the band body around the penetrating portion, it is possible to prevent a rattling of the decorative member.

Therefore, it is possible to hold the band body and the decorative member in a state of being certainly attached to each other without metal insert molding, to prevent a rattling of the decorative member, and to improve the aesthetic appearance of the band.

According to the band of the invention claimed in claim 4, in addition to the effect obtained by the invention claimed in claim 3, because the decorative member and the holding member are integrated by joining, it is possible to obtain a stable joining force between the decorative member and the holding member. Further, when the decorative member and the holding member are rigid bodies, deformation, of the decorative member and the holding member by a bending force, a twisting force or the like, of the band body, for example, made of soft synthetic resin is small.

According to the band of the invention claimed in claim 5, in addition to the effect obtained by the invention claimed in claim 4, because the band body is sandwiched between the rear side member and the front side member, of the holding member, it is possible to make it difficult to transmit a bending force, a twisting force or the like, of the band body to the decorative member, so that it is possible to obtain such advantage as to obtain more stable fixing force for decorative member.

According to the band of the invention claimed in claim 6, as the invention claimed in claim 3, it is possible to certainly attach the decorative member which is made of metal or synthetic resin to the band body which is made of soft synthetic resin, with relatively plain structure, and to prevent the rattling of the decorative member.

According to the band of the invention claimed in claim 7, because the decorative member is inserted into the penetrating hole of the band body, thereafter, it is engaged to the band body by one end portion and the other end portion, it is possible to certainly attach the decorative member to the band body, with relatively plain structure.

Therefore, it is possible to obtain the unity of the band with the band body having the decorative member like a coinjection molding without the space and the turnover, and to improve the aesthetic appearance of the band.

According to the band of the invention claimed in claim 8, in addition to the effect obtained by the invention claimed in claim 7, because the connecting portion in the other end portion of the decorative member is engaged to the supplementary penetrating portion of which the position is different from the position of the penetrating portion of the band body, it is possible to obtain such advantage as to certainly prevent producing a space and turnover of the decorative member.

According to the band of the invention claimed in claim 9, in addition to the effect obtained by the invention claimed in claim 7, because connecting portion of the decorative member which is inserted to the penetrating portion from the front surface side of the band is engaged to the connecting recess portion or the connecting projecting portion of the penetrating portion of the band body in the rear surface side of the band, it is possible to certainly prevent producing a space and turnover of the decorative member.

According to the wrist device of the invention claimed in claim 10, because the portion of the case complete is covered with the covering portion which is formed in the band, it is possible to make the wrist device have a high harmonious design between the case complete and the band without being conscious the joints between them, so that it is possible to obtain the unity of the wrist device.

According to the wrist device of the invention claimed in claim 11, because the decorative member is attached to the band body, it is possible to decorate the band body by the decorative member. Further, because the portion of the case complete is covered with the covering portion which is formed in the decorative member, it is possible to make the wrist device have a high harmonious design between the case complete and the band body without being conscious the joints between them. Therefore, it is possible to obtain the unity of the wrist device.

According to the wrist device of the invention claimed in claim 12, because the decorative member is approximately flush with the band body, it is possible to improve the unity of the decorative member and the band body.

According to the wrist device of the invention claimed in claim 13, because the decorative member is positioned to the band body by that the projecting portion which is formed in the band body is inserted to the recess portion or the hole portion which is formed in the decorative member, it is possible to suitably prevent the slip and the rattling, of the decorative member against the band body.

According to the wrist device of the invention claimed in claim 14, because the portion of the band body, corresponding to the projecting portion has approximately the same easiness of flexibility as that of the peripheries of other portions of the band body in the state of attaching the decorative member to the band body, it is possible to make the feelings to wear the wrist device by the band pleasant.

According to the wrist device of the invention claimed in claim 15, because the colors, of the band body and the decorative member are different from each other, it is possible to obtain the design which looks like that the band body and the decorative member are made by a coinjection molding.

According to the wrist device of the invention claimed in claim 16, because the covering portion is approximately flush with the peripheral portion thereof, it is possible to make the wrist device have such design as not to be conscious the joints between the covering portion and the peripheral portion thereof. Therefore, it is possible to improve the unity of the band or band body and the case complete, so that it is possible to obtain higher unity of the wrist device.

What is claimed is:

1. A wrist device comprising:

a case body; and a band comprising a band body attached to the case body, and a decorative member attached to the band body;

wherein said decorative member is positioned on the band body by inserting a projecting portion formed on the band body into a recess or hole portion formed in the decorative member; and wherein said decorative member comprises a covering portion, and a portion of the case body is covered by the covering portion.

2. The wrist device as claimed in claim 1, wherein the decorative member is approximately flush with the band body.

3. The wrist device as claimed in claim 1, wherein a portion of the band body, corresponding to the projecting portion and a periphery thereof, has approximately a same flexibility as other portions of the band body in a state where the decorative member is attached to the band body.

4. The wrist device as claimed in claim 1, wherein the band body and the decorative member have different colors.

* * * * *